US011602256B2

(12) United States Patent
Dunn et al.

(10) Patent No.: US 11,602,256 B2
(45) **Date of Patent: *Mar. 14, 2023**

(54) MAGNETIC SPONGE ASSEMBLY

(71) Applicant: MUNCHKIN, INC., Van Nuys, CA (US)

(72) Inventors: Steven Bryan Dunn, Beverly Hills, CA (US); Matthew Joseph Saxton, Moorpark, CA (US); Kwok Ping Kuen, Kowloon (CN)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/538,436

(22) Filed: Nov. 30, 2021

(65) Prior Publication Data

US 2022/0257082 A1 Aug. 18, 2022

Related U.S. Application Data

(63) Continuation of application No. 17/177,139, filed on Feb. 16, 2021, now Pat. No. 11,185,208.

(51) Int. Cl.
*A47L 13/16* (2006.01)
*A47L 13/42* (2006.01)

(52) U.S. Cl.
CPC ..... *A47L 13/16* (2013.01); *A47L 13/42* (2013.01)

(58) Field of Classification Search
CPC ..... A47L 13/00; A47L 13/16; A47L 13/10; A47L 13/42; F16B 2001/0035; A47G 1/17; A47G 2001/067
USPC ..... 248/206.5; 15/118, 244.3
See application file for complete search history.

(56) References Cited

U.S. PATENT DOCUMENTS 7,955,683 B1 * 6/2011 Ferrell ..... A63B 57/60 15/209.1
2014/0332030 A1 * 11/2014 Trudeau ..... A47L 1/12 134/6

FOREIGN PATENT DOCUMENTS

EP 3524124 A1 * 8/2019 ..... A47L 13/16

OTHER PUBLICATIONS

Author: Hacktuber Title Magnet Sponge LifeHack Publication Date:Aug. 19, 2015 URL:https://www.youtube.com/watch?v=0OUHc6DhDpw (Year: 2022).*
Machine Translation of description of EP3524124. Retrieved 2022 (Year: 2022).*

* cited by examiner

*Primary Examiner* — Don M Anderson
*Assistant Examiner* — Sarah Akyaa Fordjour
(74) *Attorney, Agent, or Firm* — Robert Z. Evora, Esq.

(57) ABSTRACT

A multi-layer sponge assembly is disclosed which contains a magnetic button that mates with a separate magnetic element to allow the sponge to be elevated in a suspended position to dry.

20 Claims, 30 Drawing Sheets

MAGNETIC SPONGE ASSEMBLY

CROSS REFERENCE TO RELATED APPLICATIONS

This Continuation Application claims priority to U.S. patent application Ser. No. 17/177,139 filed Feb. 16, 2021, the contents of which are hereby incorporated by reference herein in their entirety into this disclosure.

TECHNICAL FIELD

The subject disclosure relates to sponges and sponge assemblies having magnetic properties.

BACKGROUND

One of the most ubiquitous cleaning tools used worldwide is the common sponge. It can be used to clean virtually any surface, such as sinks and counter tops, as well as specific items, such as dishes and utensils. Common dish sponges are typically made of one or more porous materials which allow the absorption of fluids, usually containing detergents or soaps. Since the sponge is used to clean another object, the sponge usually "picks up" the debris of the object it is cleaning and becomes contaminated itself. Additionally, repeated use of the sponge can lead to the accumulation of mold, mildew, or other undesirable microorganisms such as bacteria and viruses. Thus, although the sponge is used to clean objects, such as dishes, the sponge picks up the food material or other living or inert contaminants from the dish, which then often gets retained within the porous structure of the sponge. Further, after use, the sponge is usually left in the bottom of the sink, on a counter or in a soap dish which further contaminates the sponge and prevents the proper draining from the sponge of the fluid which is tainted by grease and food debris. Moreover, when the sponge is left at the bottom of the sink, water and food material splash on the sponge which further contaminates the sponge and prevents proper drying.

Thus, there is a need for a sponge which is portable, easy to use, easy to drain, easy to clean, and has a built-in design to promote drying and decrease contamination.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

While various aspects, features, or advantages of the subject disclosure are illustrated in reference to common sponges, such aspects and features also can be exploited in various other industrial sponge or materials used for cleaning.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

In one exemplary embodiment, the present subject disclosure is a sponge. The sponge includes a first material having a first material property; a second material having a second material property; and a magnetic disk connecting to the first material and to the second material.

In another exemplary embodiment, the present subject disclosure is a sponge. The sponge includes a first material having a first material property; a second material having a second material property, completely layered upon the first material such that they have a thickness and share a single peripheral edge; a spool-shaped magnetic disk having a top surface and a bottom surface and connecting to the first material and to the second material, such that a distance from its top surface to its bottom surface is less than the thickness of the first material layered upon the second material.

In yet another exemplary embodiment, the present subject disclosure is a sponge assembly. The sponge assembly includes a sponge comprising: a first material having a first material property; a second material having a second material property; and a magnetic disk positioned to connect with the first material and to the second material; and a magnetic element, which mates with the magnetic disk.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1:
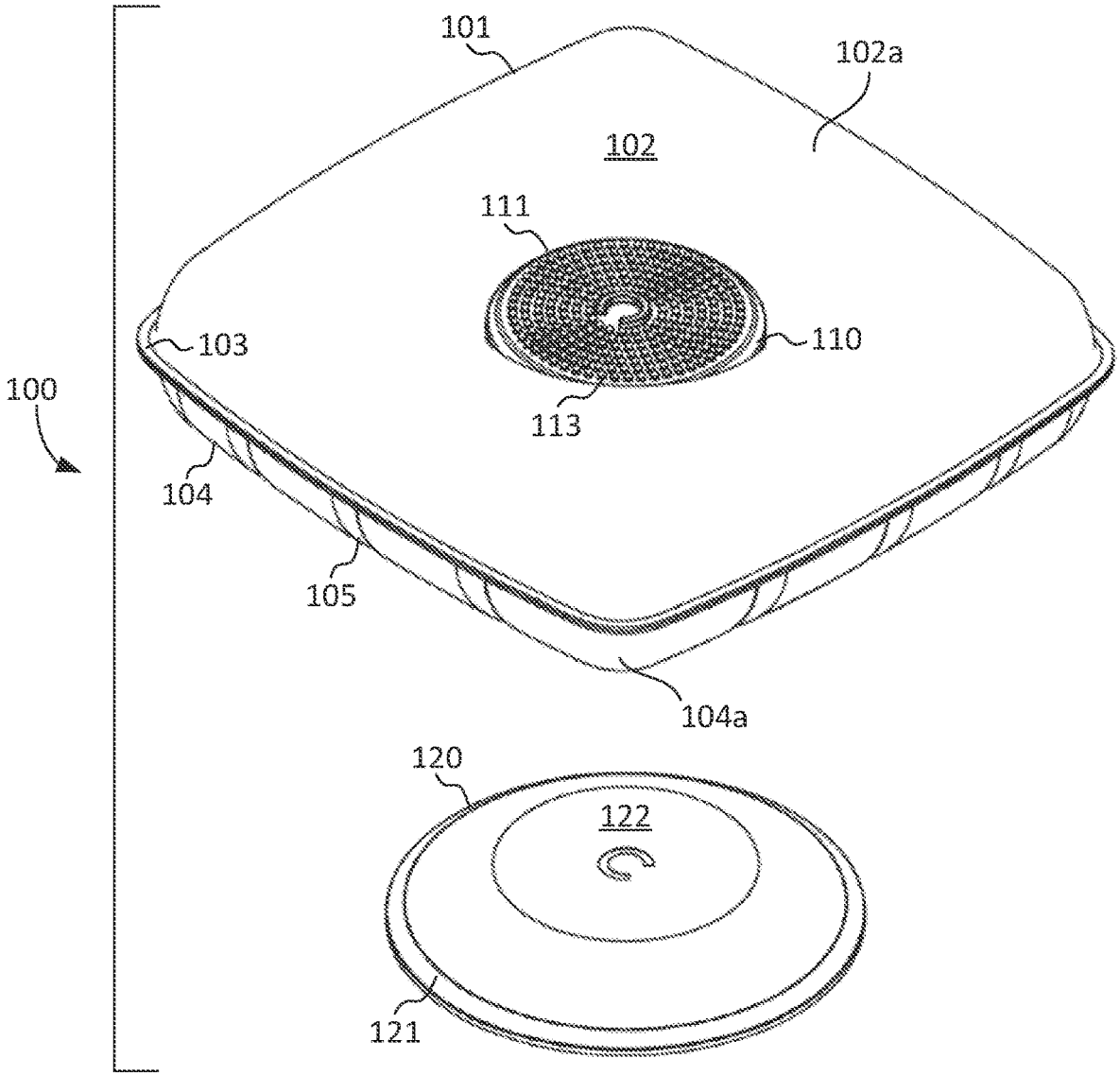
FIG. 1 is a front perspective view of a sponge assembly with a magnetic feature, according to an exemplary embodiment of the present subject disclosure.

Particular embodiments of the present subject disclosure will now be described in greater detail with reference to the figures.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

The present subject disclosure provides a sponge assembly that contains a magnetic feature and a metallic material such that the magnetic feature may be attached to a wall of a sink, for example, thereby allowing the sponge to attach to it via its metallic material. Thus, instead of a soaked sponge being placed in a soap dish or on the bottom of the sink, the sponge is now capable of being hung, or suspended, on a vertical wall without any impediment on its bottom surface, and allowed to dry more thoroughly. The capability provided by the present subject disclosure promotes the quicker drying of the sponge and decreases the likelihood of contamination of the sponge.

Various exemplary embodiments of the subject disclosure are presented throughout the figures. Multiple perspective views of a sponge assembly according to an exemplary embodiment of the present subject disclosure are presented in various embodiments. A first exemplary embodiment is presented in FIGS. 1-7B. A second exemplary embodiment is presented in FIGS. 8-13B. A third exemplary embodiment is presented in FIGS. 14-20B and FIGS. 23A-24D. Further alternative embodiments are presented in FIGS. 21A-22B. The components shown in any one exemplary embodiment may be interchanged or substituted with an equivalent component in any other exemplary embodiment. All such combinations are not shown for sake of brevity, but will be appreciated by one having ordinary skill in the art after consideration of the present subject disclosure.

It should be noted that a uniform numbering system has been used to designate the same or similar components in the various embodiment for sake of simplicity and brevity. The first digit of the three digit labeling scheme refers to a particular embodiment, and the next two digits relate to a particular component. For example, scrub button 110 relates to the scrub button "10" in the first embodiment, scrub button 210 relates to the scrub button "10" in the second embodiment, etc. These scrub buttons are interchangeable although shown in different embodiments. If a particular labeled element in the drawings does not have a written description in the specification, the description of a similarly numbered item is applicable. If there is a difference between two similarly labeled items (e.g., seam 103, seam 203, seam 303), then that difference will be described below.

A first exemplary embodiment of a sponge and sponge assembly is shown in FIGS. 1-7C.

Figure 2:
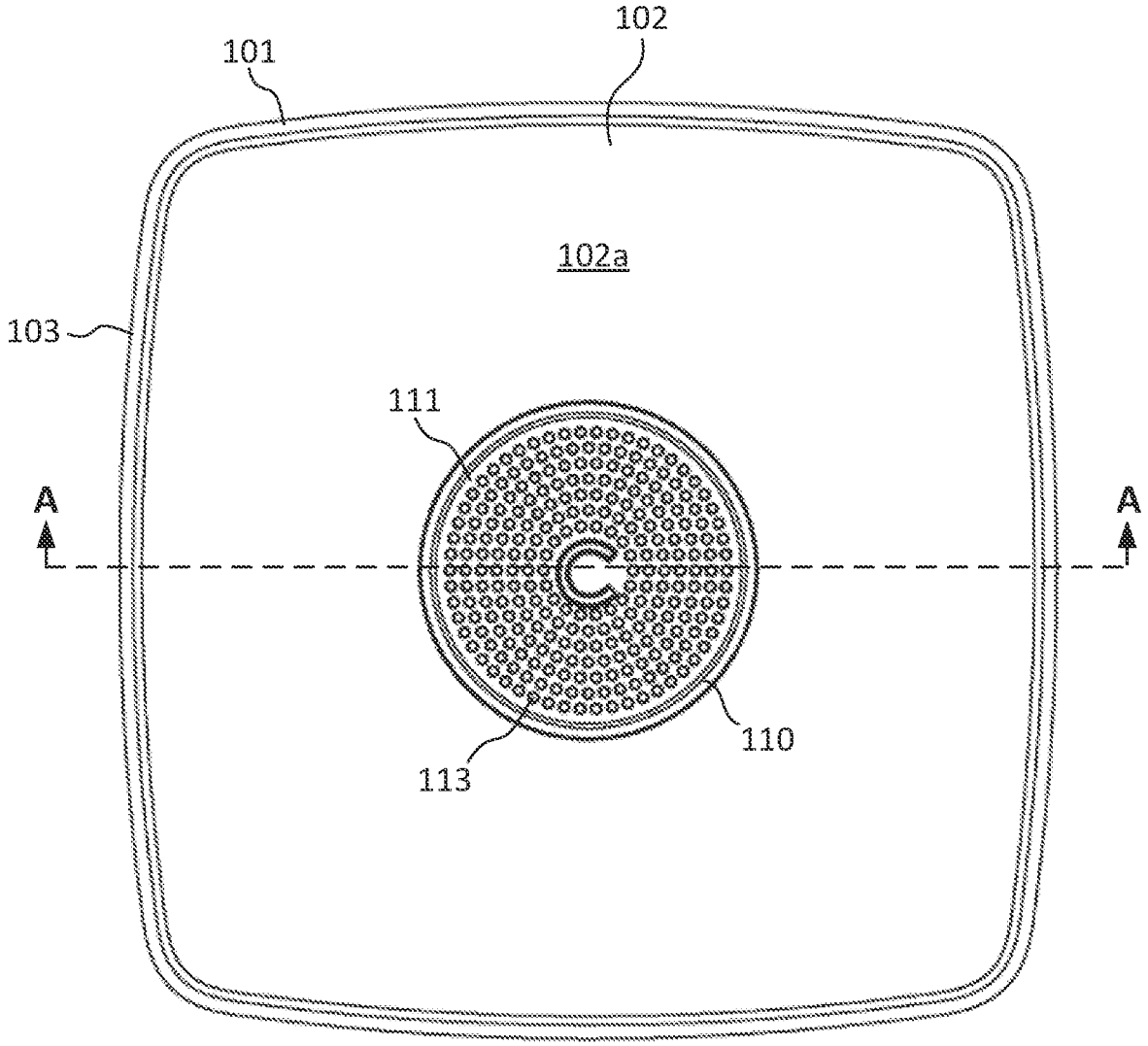
FIG. 2 is a top view of a sponge, according to an exemplary embodiment of the present subject disclosure.

As shown in FIGS. 1-7C, a sponge assembly 100 includes a sponge 101 and a magnetic disk or magnetic element 120. The sponge 101 may be in any shape but is shown as a pillow-like square, and includes a top portion or a top half 102 and a bottom portion or a bottom half 104 which are sealed together at a seam 103, which spans the periphery of the sponge 101. The top half 102 has a top sponge surface 102*a* and the bottom half 104 has a bottom sponge surface 104*a*. A scrub button 110 is positioned within the sponge 101 and has a top surface 111 with a plurality of finger-like projections 113, such as bristles, as shown in FIG. 2.

Figure 3:
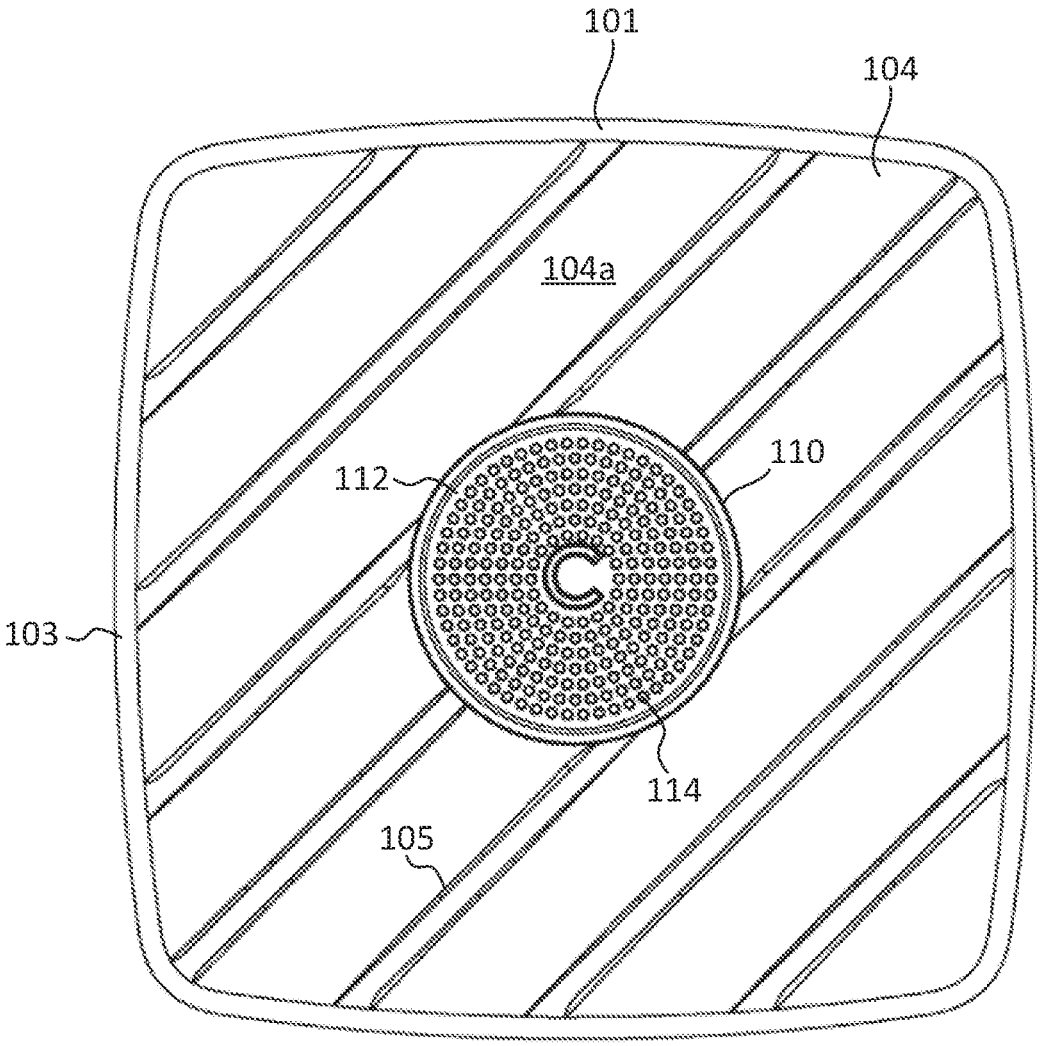
FIG. 3 is a bottom view of a sponge, according to an exemplary embodiment of the present subject disclosure.

The scrub button 110 is presented in a circular shape throughout the specification and drawings, but it is not limited to such a shape and may be any shape as long as it functions as described herein. The scrub button 110 further has a bottom surface 112 with a plurality of finger-like projections 114, such as bristles, as shown in FIG. 3. The projections 113 on top surface 111 and projections 114 on bottom surface 112 may be constructed of a relatively stiff, yet resilient material, such as rubber, which is used to scrub the surface of an object during use of the sponge 101. The top projections 113 and bottom projections 114 may have different lengths, sizes, shapes, stiffness, or configurations, as desired, to produce different cleaning and use options. Additionally, a scrapping edge may be disposed on either the top or bottom surface 111, 112. The scraping edge may be disposed around a perimeter of the top or bottom surfaces 111, 112 of the scrub button 110. Alternatively, the seam 103 may function as a scraping edge due to the inherent material properties of the seam 103 or because of the addition of a more rigid material along the seam 103.

As shown in FIGS. 1-3, the top surface 111 or bottom surface 112 may include a logo or brand identifier. The logo may be formed in the surface 111, 112, or may be formed by the top projections 113 or the bottom projections 114. The logo may therefore contribute to the scrubbing power of the scrub button 110. The logo may be of a different stiffness, coarseness or resilience than the surrounding projections 113, 114. The logo may be a scrapping edge that provides greater leverage and scrubbing stiffness for removing tough stains and food that may be firmly stuck to a surface.

Further, the scrub button 110 may have various internal structures between its top and bottom surfaces 111 and 112, as will be described in various embodiments below, and any of such variations may be substituted into any other embodiment shown and described herein.

Figure 4A:
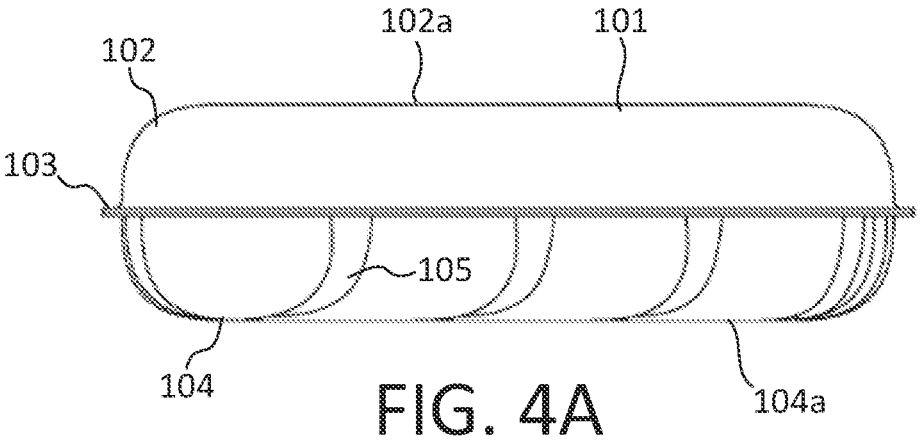
FIG. 4A is a right side view of a sponge, according to an exemplary embodiment of the present subject disclosure.
Figure 4B:
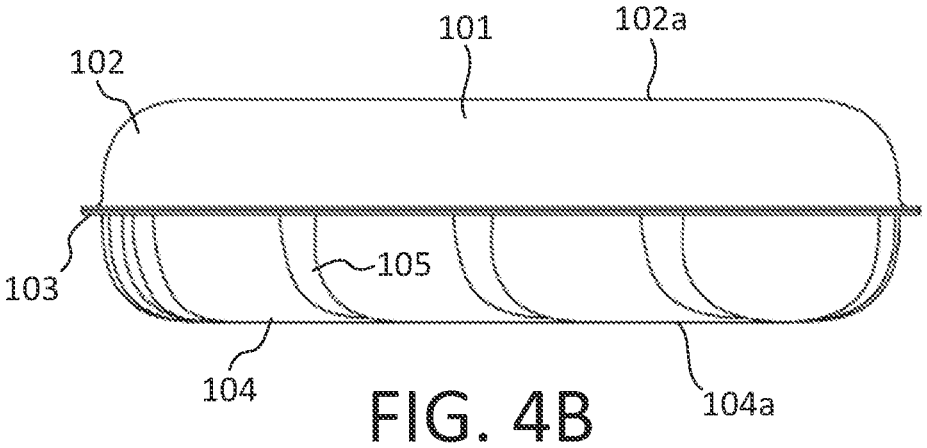
FIG. 4B is a left side view of a sponge, according to an exemplary embodiment of the present subject disclosure.
Figure 7A:
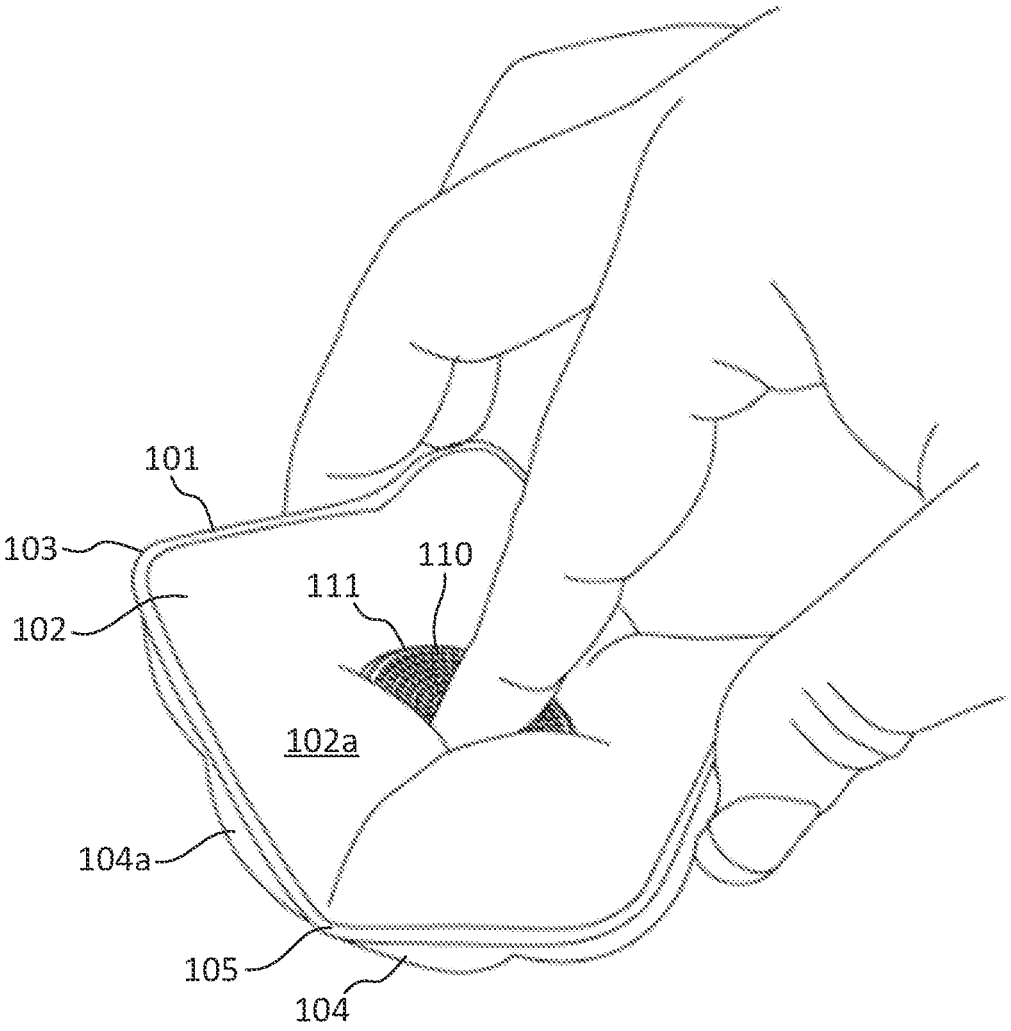
FIG. 7A is a perspective view of a sponge in use, according to an exemplary embodiment of the present subject disclosure.

As best shown in FIGS. 3-4B, the bottom sponge surface 104*a* includes one or more transverse seams 105 that span across the entirety of the bottom sponge surface 104*a* in any pattern including parallel lines, zig zag or any other configuration. The transverse seams 105 serve to facilitate the bending of the bottom half 104, as shown in FIGS. 7A and 7C. The transverse seams 105 create an intentionally uneven surface having channels of varying width and depth that contributes to the scraping, or abrasive scuffing along a surface being cleaned. The transverse seams 105 may facilitate the retention of soap or other cleaning agent during use. Additionally, when a user pushes and pulls the sponge 101 over a surface, the shape of the transverse seams 105 generate scrubbing leverage without the application of unnecessary or excessive force.

The top half 102 of the sponge 101 may be constructed of an absorbent material commonly used in sponge fabrication such as, for example, polyester, polyurethane, vegetable cellulose, etc. The bottom half 104 of the sponge 101 may also be constructed of the same material used in the construction of the top half 102. Alternatively, the bottom half 104 may be constructed of material which is coarser, or stiffer, or more abrasive, or have a higher tear strength, or have higher absorbency than that of top half 102. Alternatively, the bottom half 104 may be constructed of material which is less coarse, less stiff, or less abrasive, or have a lower tear strength, or have lower absorbency than that of top half 102. Having two different materials for the top half 102 and bottom half 104 allows the use of different sides of the sponge 101 for different tasks or different objects to be cleaned. Further, having two layers of different abrasiveness allows the softer material (for example, top half 102) to be supported by the stiffer material (for example, bottom half 104).

A magnetic element 120 is shown in FIGS. 5A-5D and is capable of working with any of the scrub button surfaces (top 111 or bottom 112) in any of the embodiments shown in the present subject disclosure. The magnetic element 120 is shown as a circular disk, having a first bottom planar portion 122 and a second top planar portion 124. A sloped transition surface 123 connects the first bottom planar portion 122 to the second top planar portion 124. The sloped transition surface 123 may have a positive or negative curvature in order to promote the run-off or retention of a liquid. An external peripheral edge 121 encircles the first bottom planar surface 122. A bottom side 125 of the magnetic element 120 is adapted to stick to a planar surface, and may be a suction cup, high friction surface, adhesive, a micro suction material, or any material or configuration that enables the magnetic element 120 to reversibly or permanently attach to a given flat surface. For example, a suction surface may be used for bottom side 125.

The magnetic element 120 may be over-molded with thermoplastic elastomers (TPE) or silicone or other similar material using known techniques, as appreciated by one having ordinary skill in the art. The magnetic element 120 may be any shape as long as it functions as described herein, including a strip of magnetic material, a magnetic frame, or a magnetic tray. Different versions of the magnetic element 120 and other magnetic cleaning instruments that operate under the same principles as the current subject disclosure and may complement the use of the magnetic sponge 101, are disclosed in U.S. application Ser. No. 16/806,924, the entirety of which is incorporated herein by reference.

Figure 5A:
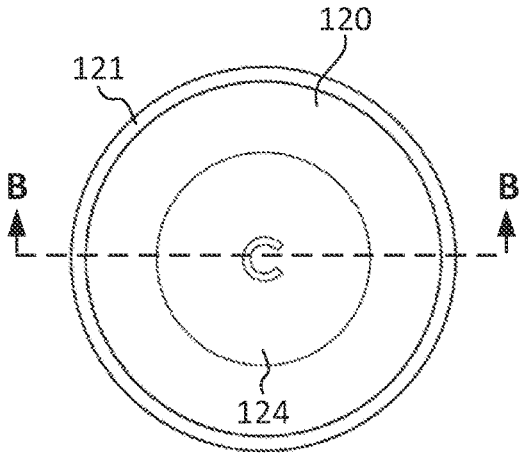
FIG. 5A is a top view of a magnetic feature, according to an exemplary embodiment of the present subject disclosure.
Figure 5B:
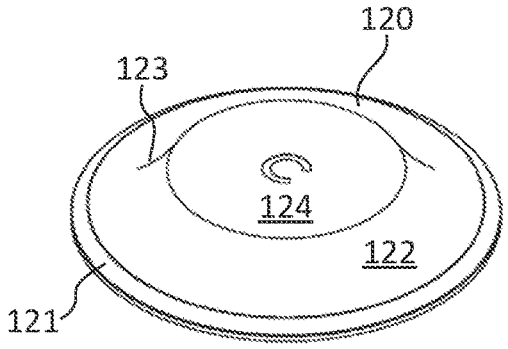
FIG. 5B is a side perspective view of a magnetic feature, according to an exemplary embodiment of the present subject disclosure.
Figure 5C:
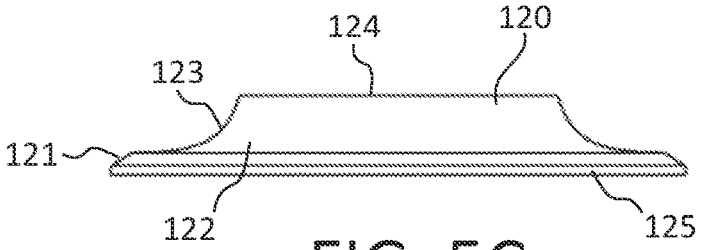
FIG. 5C is a side view of a magnetic feature, according to an exemplary embodiment of the present subject disclosure.
Figure 5D:
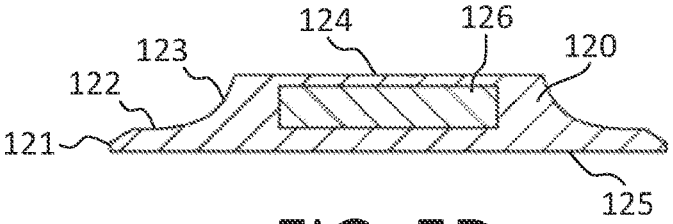
FIG. 5D is a side cross-sectional view of a magnetic feature along plane B-B of FIG. 5A, according to an exemplary embodiment of the present subject disclosure.

As best shown in FIG. 5D, which is a cross sectional planar cut B-B of FIG. 5A, the magnetic element 120 includes an internal magnet 126, which mates with the scrub button 110 of sponge 101, as will be described in detail below. Alternately, a magnetic element may be incorporated into the scrub button 110 as will be described later. In use, the mating of the scrub button 110 to the magnetic element 120 in the sponge 101 may cause or be accompanied by an audible noise that alerts a user that a secure attachment has been made.

Figure 6A:
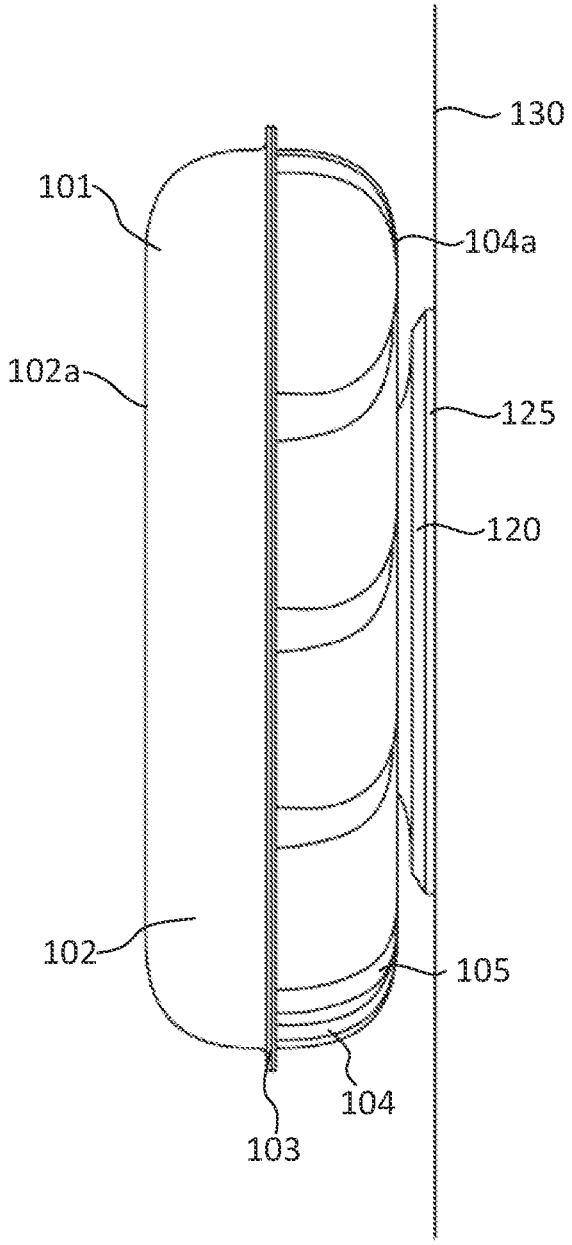
FIG. 6A is a side view of a sponge attached to a magnetic feature that is affixed to an attachment surface, according to an exemplary embodiment of the present subject disclosure.
Figure 6B:
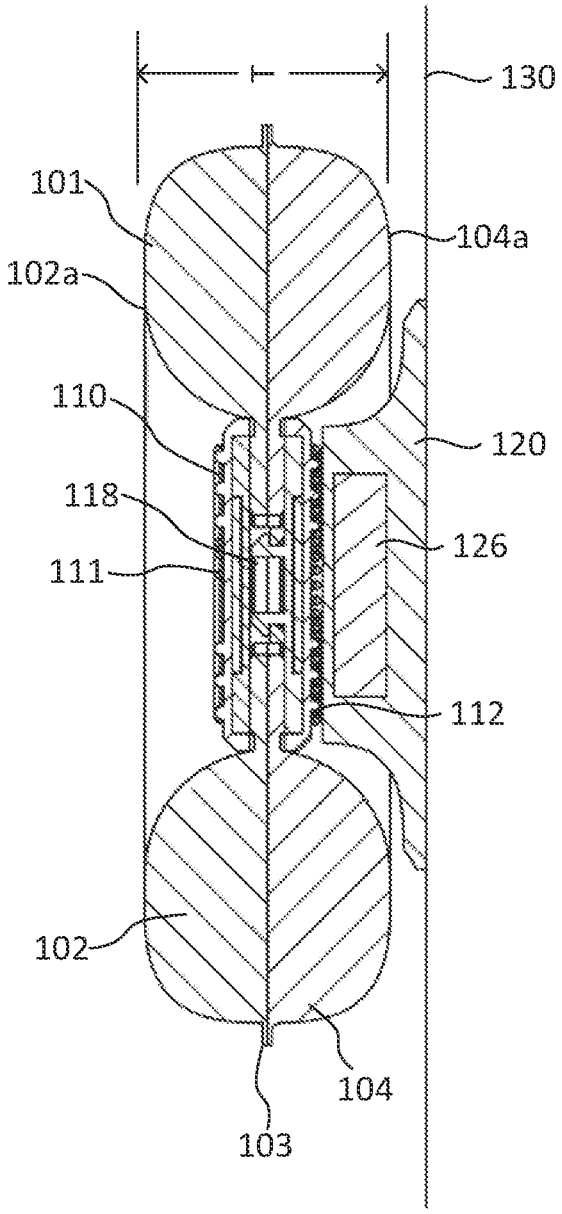
FIG. 6B is a side cross-sectional view of a sponge along plane A-A of FIG. 2 attached to a magnetic feature shown in a side cross-sectional view along plane B-B of FIG. 5A, according to an exemplary embodiment of the present subject disclosure.

As shown in FIGS. 6A-6B, the mating attachment of scrub button 110 to the magnetic element 120 allows the sponge 101 to be stored in a suspended or hanging position from an attachment surface 130 that is elevated off of a wet surface. By hanging the sponge 101, air circulation is promoted to increase the speed of the drying process. By minimizing contact with wet or potentially contaminated surfaces and facilitating air drying, the hanging storage position leads to quicker drying and a cleaner overall sponge 101. The accumulation of mold, mildew or other undesirable microorganisms may, therefore, be prevented by storing the sponge 101 in the hanging position away from contaminated surfaces and with ample air circulation to rapidly dry out the sponge 101 after use.

FIG. 6A shows the bottom side 125 of the magnetic element 120 affixed to the attachment surface 130. The bottom sponge surface 104*b* of the bottom half 104 of the sponge 101 is shown abutting against the magnetic element 120 due to the attraction between the ferromagnetic material 118 disposed in the scrub button 110 and the internal magnet 126 disposed in magnetic element 120 (FIG. 6B). However, the sponge 101 may just as easily attach so that the top sponge surface 102*a* of the top half 102 is nearest to the magnetic element 120, as the scrub button 110 (FIG. 6B) is magnetically attracted to the magnetic element 120 from both the top surface 111 and the bottom surface 112 of the scrub button 110.

Figure 7B:
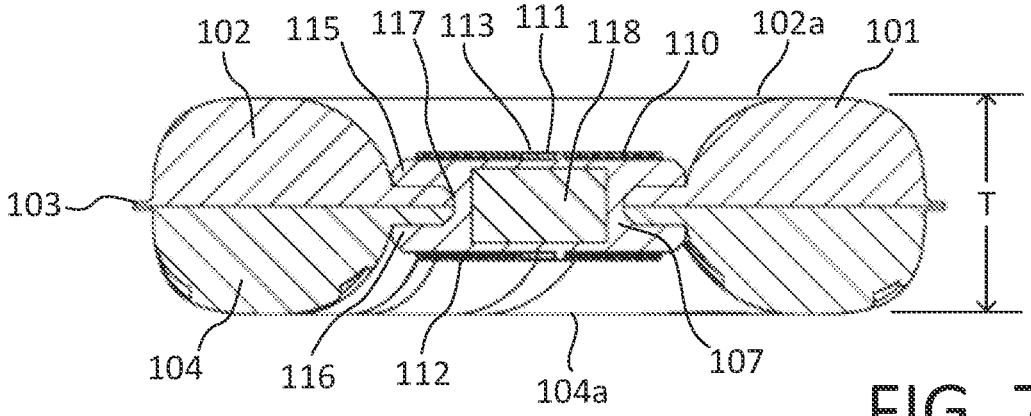
FIG. 7B is a side cross-sectional view of a sponge along plane A-A of FIG. 2 at rest, according to an exemplary embodiment of the present subject disclosure.
Figure 7C:
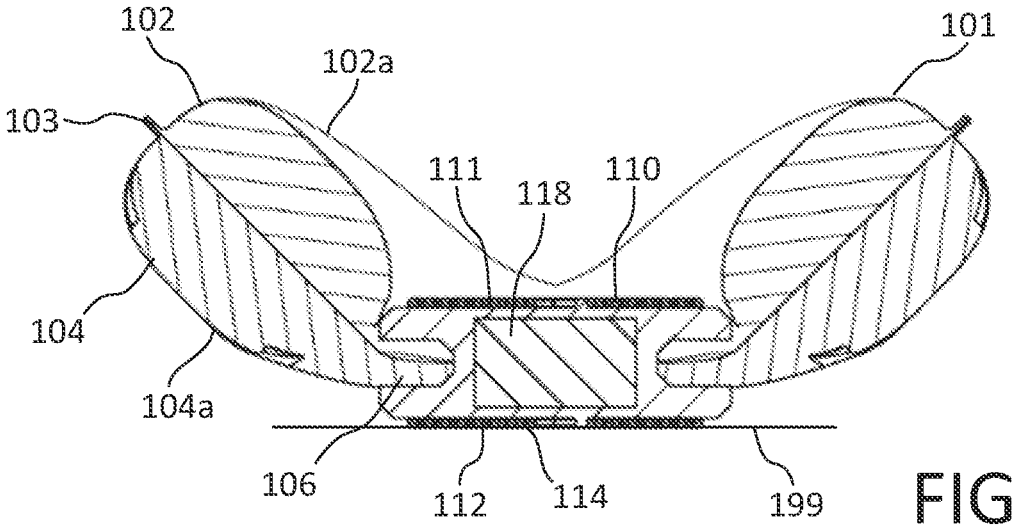
FIG. 7C is a side cross-sectional view of a sponge along plane A-A of FIG. 2 during use, according to an exemplary embodiment of the present subject disclosure.

As best shown in FIGS. 7B and 7C, which is the cross-sectional planar cut A-A of FIG. 2, the sponge 101 may be used so that the top sponge surface 102*a* or bottom sponge surface 104*a* makes contact with an object or surface which is to be cleaned or wiped. The top half 102 can have a first abrasive layer, and the bottom half 104 can have a different second abrasive layer. Either the top half 102 or the bottom half 104 may be used as desired, depending on the nature of the object to be cleaned or wiped, and the amount of abrasiveness needed to perform the task.

FIG. 7A-7C shows that sponge 101 is flexible as needed to clean a surface with the additional plurality of finger-like projections 114 on the bottom surface 112 of the scrub button 110. As shown in FIGS. 7A and 7C, given sufficient applied force, for example by exerting a force by a finger on the top surface 111 of the scrub button 110, the sponge 101 may bend enough so that the bottom surface 112 of the scrub button 110, which in a rest position is retracted (as shown in FIG. 7B), is extended below the bottom planar surface of the bottom sponge surface 104*a*. In such a configuration, the projections 114 on the bottom surface 112 of the scrub button 110 can make contact with a surface 199 of an object to be cleaned. The higher stiffness of the projections 114 with respect to the bottom half 104 provides additional abrasiveness where the cleaning/wiping force is applied, as needed.

FIGS. 7B-7C show an exemplary embodiment of the scrub button 110. In this embodiment, the scrub button 110 has a spool-like shape, with the top surface 111 having a top extension 115 and the bottom surface 112 having a bottom extension 116. The top extension 115 and bottom extension 116 create an accommodating groove 117, which is adapted to securely trap an internal projection 106 of the sponge 101.

It should be noted that the height of the scrub button 110 in some exemplary embodiments is less than the thickness (T) of the sponge 101. As shown best in FIG. 7B, the top surface 111 of the scrub button 110 falls below the top planar surface of the top sponge surface 102*a*. Similarly, the bottom surface 112 of the scrub button 110 falls above the bottom planar surface of the bottom sponge surface 104*a*. This configuration allows the top half 102 or bottom half 104 to be used as needed to clean surfaces without engaging the use of the projections 113, 114 on the respective top 111 or bottom 112 surface of the scrub button 110. Alternatively, the height of the scrub button 110 may be greater than the thickness (T) of the sponge 101 to promote use of the projections 113, 114 when scrubbing, Thus, this sponge 101 has at least six use variations: top half 102 only, bottom half 104 only, top half 102 with top projections 113, bottom half 104 with bottom projections 114, top projections only 113, and bottom projections only 114.

The sponge 101 may have a shorter life than the scrub button 110, and can therefore be removed and replaced as needed. In order to do so, in this particular embodiment, the sponge 101 is stretched so that the internal projection 106 of the sponge 101 is no longer positioned within the accommodating groove 117 and extends beyond either the top extension 115 or bottom extension 116 of the scrub button 110. The scrub button 110 can then be popped out of aperture 107 in the interior of the sponge 101, as defined by the internal projection 106. The used sponge 101 may then be disinfected or discarded, as desired. A new replacement sponge 101 may then be connected to the scrub button 110 by pushing the top extension 115 or bottom extension 116 with enough force to stretch the internal projection 106 of the sponge 101 so that it falls into place within the accommodating groove 117. Thus, the scrub button 110 may be reused while the sponge 101 may be discarded.

Because the sponge 101 is made of a softer and more absorbent material than the scrub button 110, it may wear out quicker and need to be replaced more often than the scrub button 110. However, the projections 113, 114 on the top surface 111 and bottom surface 112 of the scrub button 110 may also wear out in time, thereby necessitating the need to replace the scrub button 110 as needed.

FIGS. 7B-7C also show that the scrub button 110 houses a metallic material 118. The metallic material 118 may be ferromagnetic, an alloy, a magnet, or any other type of material that can mate with the internal magnet 126 (FIG. 5D) of magnetic element 120. Although the metallic material 118 is shown in a given internal configuration, various other configurations are also possible and within the purview of the present disclosure, as long as there is magnetic attraction between the metallic material 118 with the internal magnet 126 of the magnetic element 120. For example, the metallic material 118 may be disposed on the top surface 111 and/or the bottom surface 112 of the scrub button 110. Alternatively, the position of the internal magnet 126 and the magnetic material 118 may be interchanged so that the scrub button 110 contains the internal magnet 126 and the magnetic element 120 contains a metal 118. Additionally, both the scrub button 110 and magnetic element 120 may contain magnets 126.

A second exemplary embodiment of a sponge and sponge assembly is shown in FIGS. 8-13B.

Figure 8:
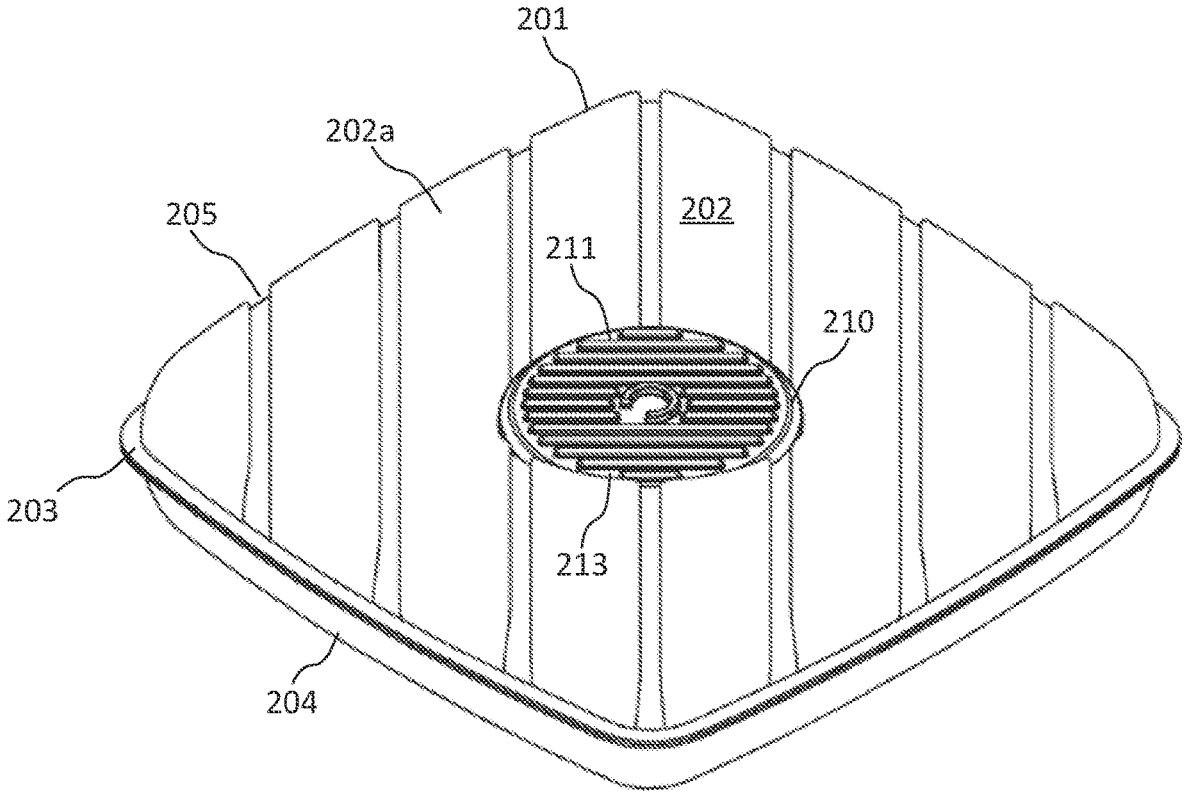
FIG. 8 is a front perspective view of a sponge, according to a second exemplary embodiment of the present subject disclosure.

As shown in FIGS. 8-13B, a sponge assembly (not shown) can include a sponge 201 in any shape but is shown as a pillow-like square, and includes a top portion or a top half 202 and a bottom portion or bottom half 204 which are sealed together at a seam 203, which spans the periphery of the sponge 201. The top half 202 has a top sponge surface 202*a* and the bottom half 204 has a bottom sponge surface 204*a*. A scrub button 210 is positioned within the sponge 201 and has a top surface 211 with a plurality of parallel top projections 213, such as ridges, as shown in FIG. 8.

Figure 10:
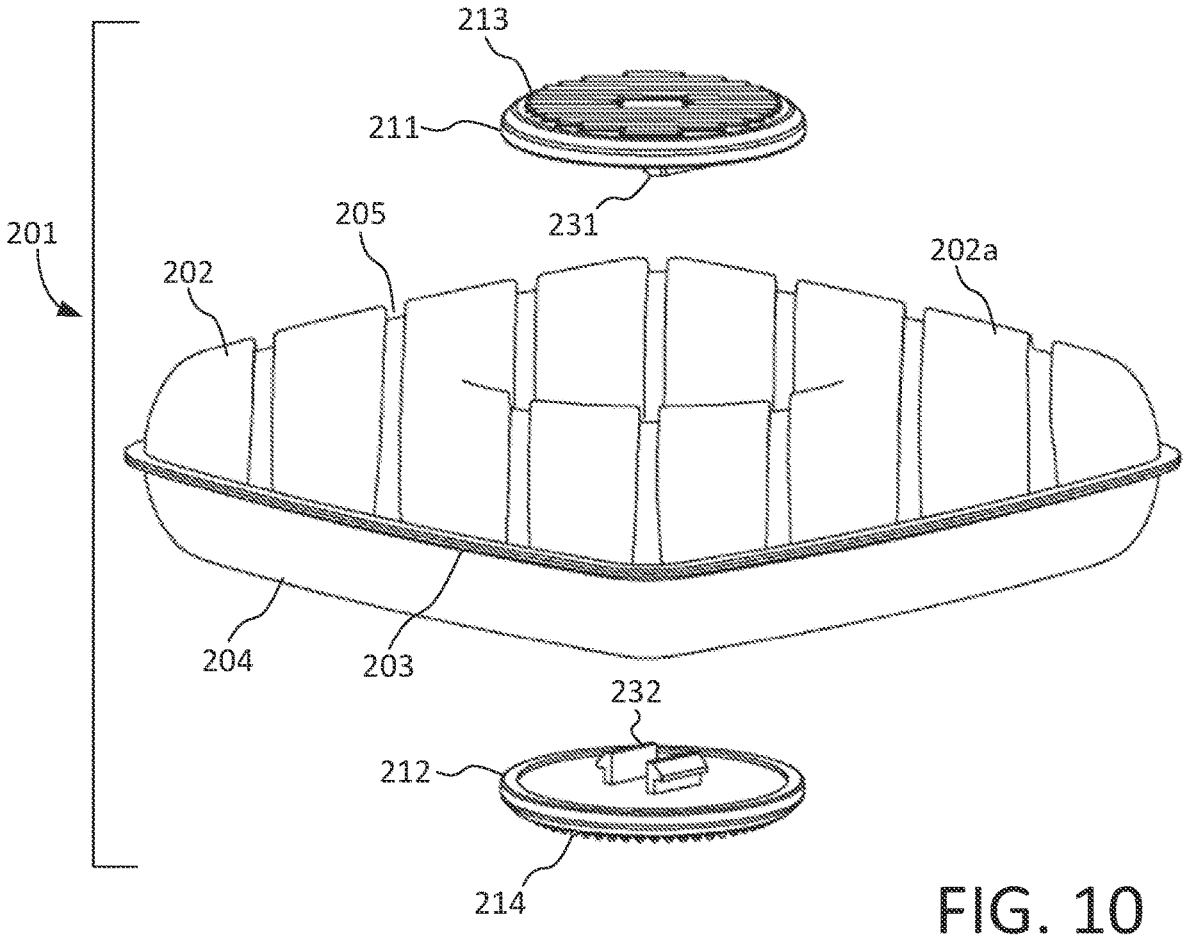
FIG. 10 is an exploded front perspective view of a sponge with a snap fit scrub button, according to a second exemplary embodiment of the present subject disclosure.

The scrub button 210 is presented in a circular shape, but it is not limited to such a shape and may be any shape as long as it functions as described herein. The scrub button 210 further has a bottom surface 212 with a plurality of parallel bottom projections 214, such as ridges, as shown in FIG. 10. The projections 213 on top surface 211 and projections 214 on bottom surface 212 may be constructed of a relatively stiff, yet resilient material, such as rubber, which is used to scrub the surface of an object during use of the sponge 201. The top projections 213 and bottom projections 214 may have different lengths, sizes, shapes, stiffness, or configurations, as desired, to produce different cleaning and use options.

Figure 9:
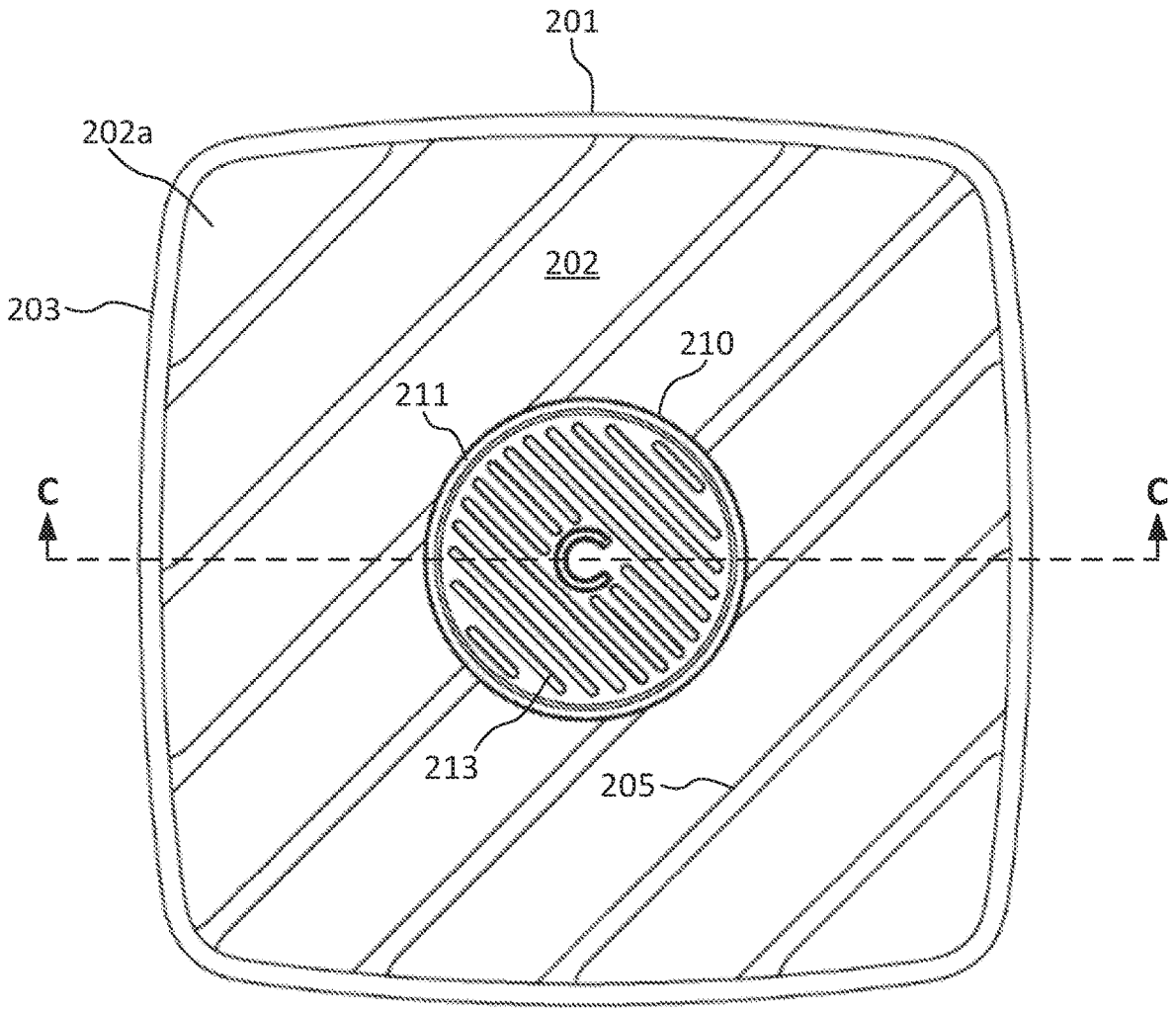
FIG. 9 is a top view of a sponge, according to a second exemplary embodiment of the present subject disclosure.

As best shown in FIGS. 8-10, the top sponge surface 202*a* includes one or more transverse seams 205 that span across the entirety of the top sponge surface 202*a* in any pattern including parallel lines, zig zag or any other configuration. The transverse seams 205 serve to facilitate the bending of the top half 202, similarly to that shown in FIGS. 7A and 7C.

Figure 11A:
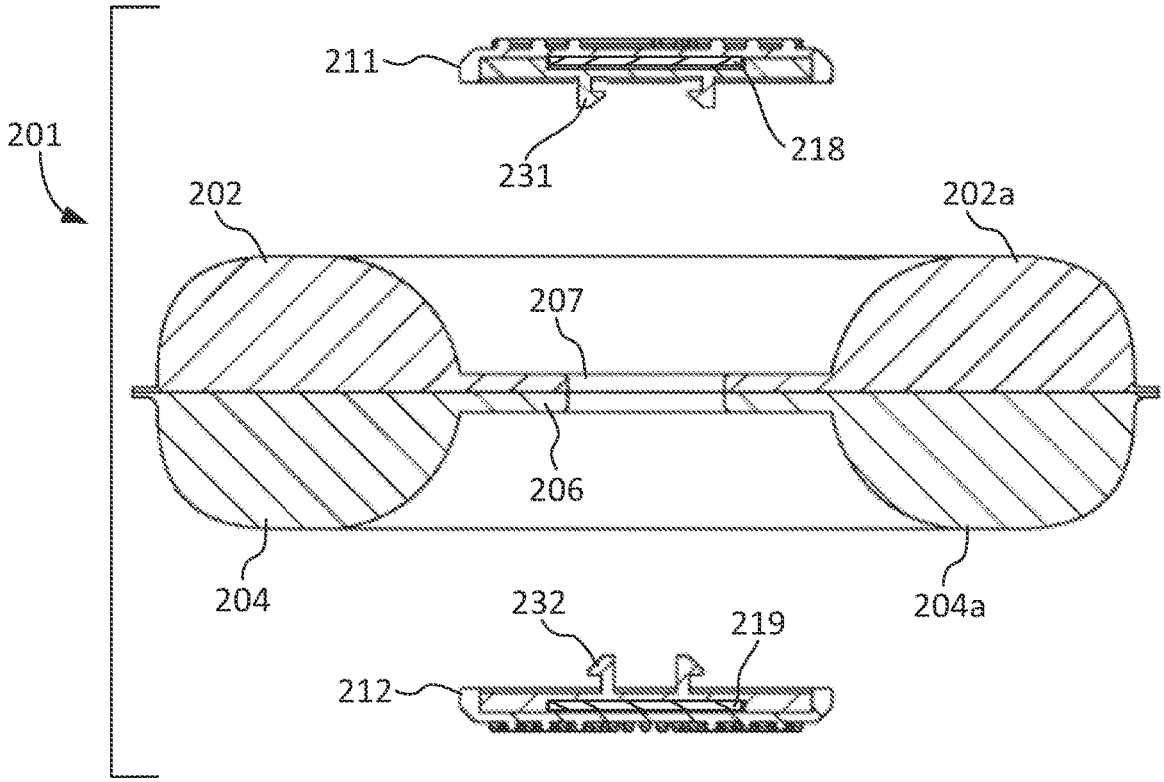
FIG. 11A is a side cross-sectional view of a sponge along plane C-C of FIG. 9 at rest with a snap fit scrub button removed, according to a second exemplary embodiment of the present subject disclosure.
Figure 11B:
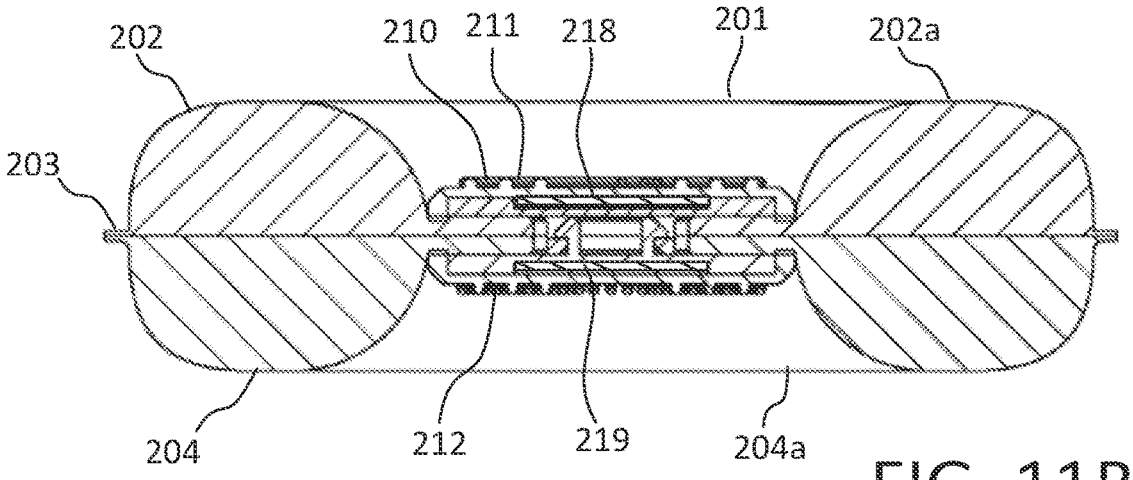
FIG. 11B is a side cross-sectional view of a sponge along plane C-C of FIG. 9 at rest with a snap fit scrub button in place, according to a second exemplary embodiment of the present subject disclosure.

As best shown in FIGS. 11A and 11B, which is the cross-sectional planar cut C-C of FIG. 9, the sponge 201 may be used so that the top sponge surface 202*a* or bottom sponge surface 204*a* makes contact with an object or surface which is to be cleaned or wiped.

The second embodiment of the sponge assembly with sponge 201 shown in FIGS. 8-13 is substantially the same as that shown and described for the first embodiment of the sponge assembly 100 with sponge 101, shown and described in FIGS. 1-7C. The description provided above with respect to the first embodiment applies to the second embodiment and will not be repeated for sake of brevity.

However, one difference between the embodiments lies in the position of the transverse seams 205 being on the top sponge surface 202*a* of sponge 201, as opposed to the transverse seams 105 being positioned on the bottom sponge surface 104*a* of sponge 101. Another difference between the second embodiment and the first embodiment is the shape and configuration of the scrub button 210 when compared to the scrub button 110.

FIGS. 10-11B show a first configuration of a multi-component scrub button 210 using a snap fit design. In this configuration, the scrub button 210 is separable from the sponge 201 body not by popping the scrub button 110 out of the aperture 107 as described in the first embodiment above, but by connecting/disconnecting the top surface 211 and bottom surface 212 components of the scrub button 210 through engaging/disengaging of complementary snap fit features 231/232, respectively. An internal projection 206 of the sponge 201 is trapped within the aperture 207 of the scrub button 210 when the complementary snap fit features 231/232 are engaged.

A biased projection 232 connected to the bottom surface 212 component extends beyond and snaps into a portion of the receiving projection 231 connected to the top surface 211 component. However, projecting and receiving portions of the snap fit features 232, 231 may be connected to either the top surface 211 or bottom surface 212 without altering the function of the complementary snap fit features 231/232. Further, each of the top surface 211 component and the bottom surface 212 component contain a metallic insert 218, 219, respectively, which serve to reversibly and magnetically connect to the internal magnet 126 of the magnetic element 120. Thus, either the top surface 211 or bottom surface 212 may connect with the magnetic element 120.

Figure 12:
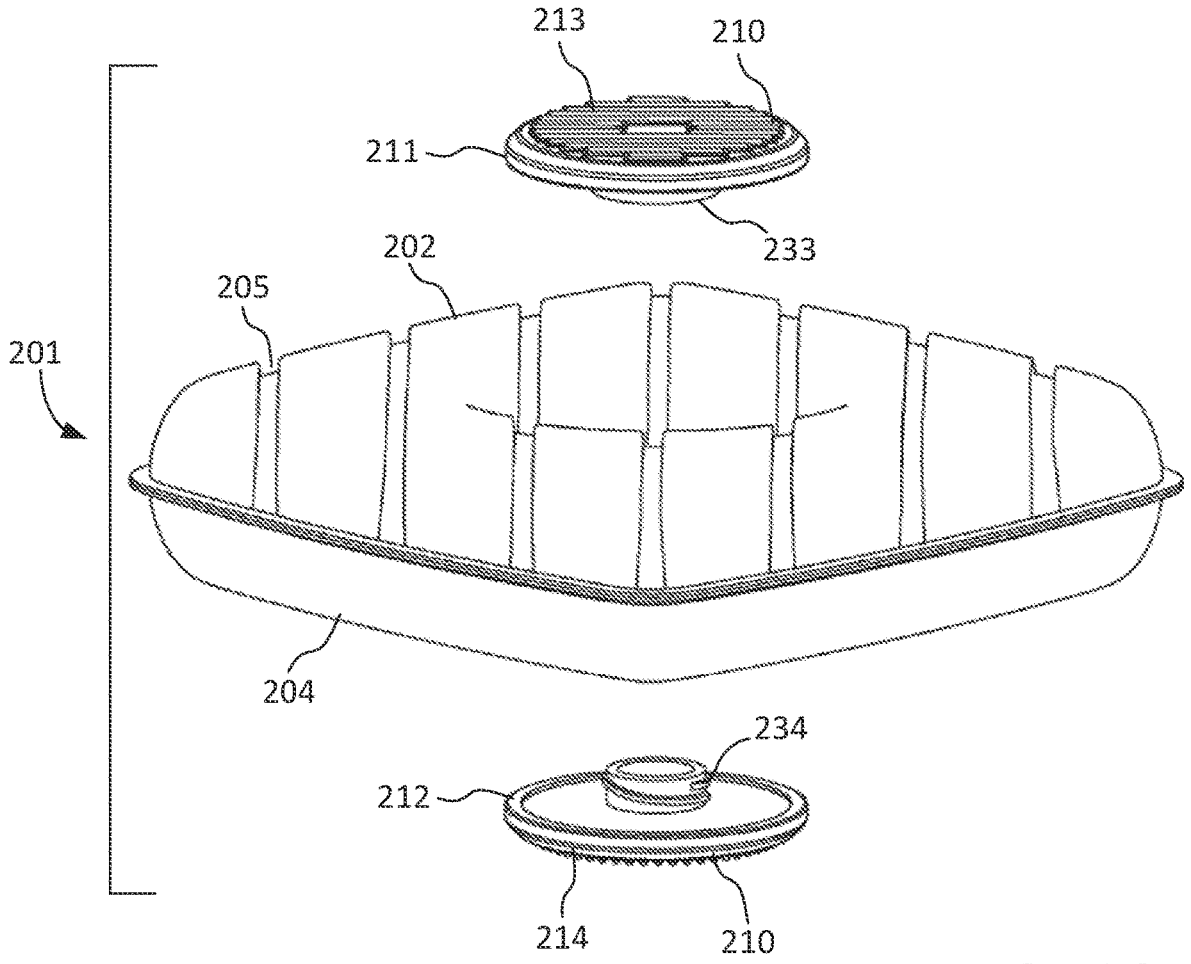
FIG. 12 is an exploded front perspective view of a sponge with a threaded feature scrub button, according to a second exemplary embodiment of the present subject disclosure.
Figure 13A:
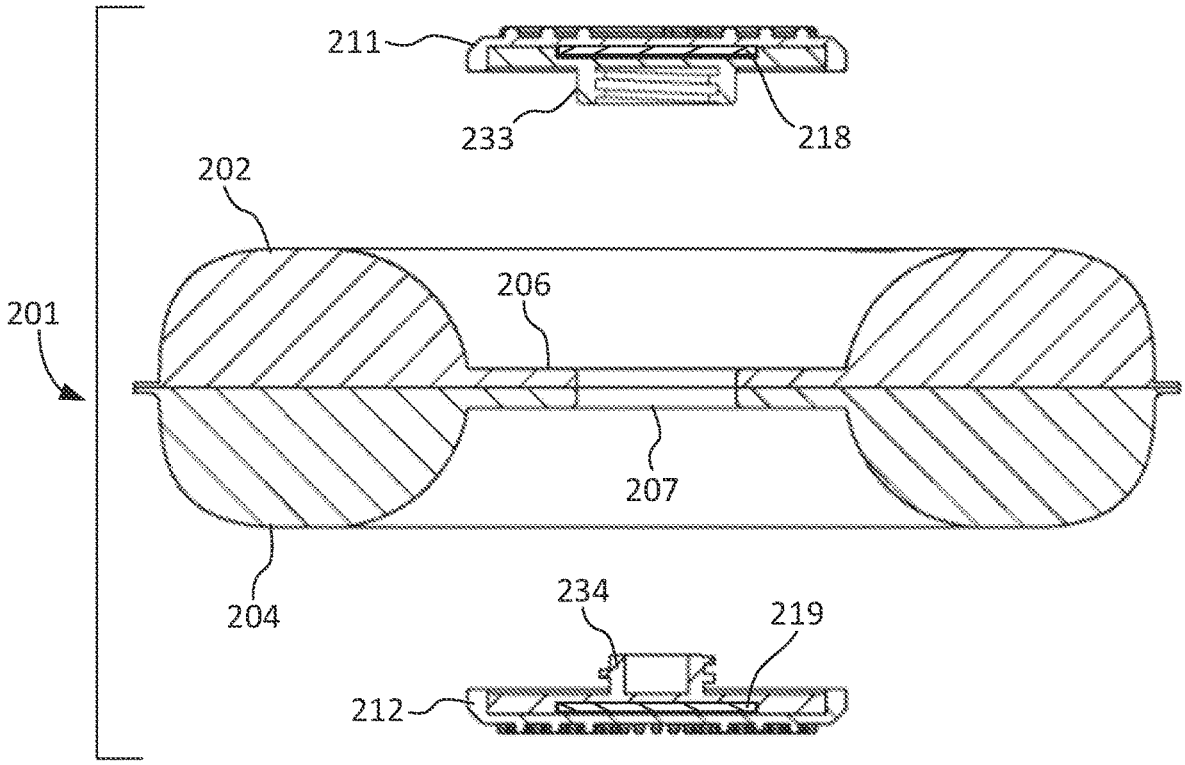
FIG. 13A is a side cross-sectional view of a sponge along plane C-C of FIG. 9 at rest with a threaded feature scrub button removed, according to a second exemplary embodiment of the present subject disclosure.
Figure 13B:
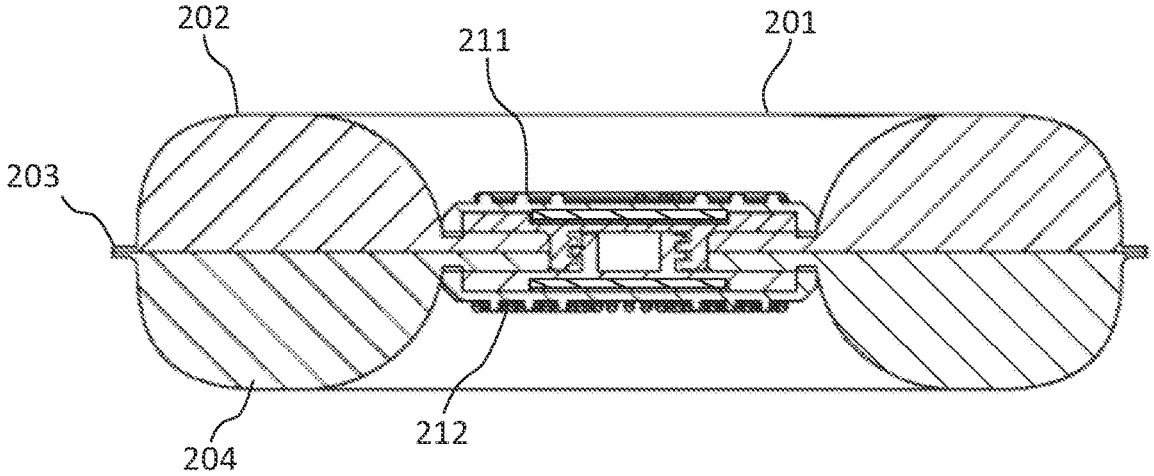
FIG. 13B is a side cross-sectional view of a sponge along plane C-C of FIG. 9 at rest with a threaded feature scrub button in place, according to a second exemplary embodiment of the present subject disclosure.

FIGS. 12-13B show a second configuration of a multi-component scrub button 210 using a threaded design. In this configuration, the scrub button 210 is separable from the sponge 201 body not by popping the scrub button 110 out of the aperture 107 as described in the first embodiment above, but by unthreading the bottom surface 212 component from the top surface 211 component. A thread pattern projecting portion 234 connected to the bottom surface 212 component extends through the sponge 201 and threads into a threaded housing portion 233 connected to the top surface 211 component. Alternatively, the threaded housing portion 233 may be connected to the bottom surface 212, with the thread pattern projecting portion 234 connected to the top surface 211. Further, each of the top surface 211 component and the bottom surface 212 component contain a metallic insert 218, 219, respectively, which serve to reversibly and magnetically connect to the internal magnet 126 of the magnetic element 120.

Although the complementary projections 231/232 (FIGS. 11A-11B) and 233/234 are shown to extend through the sponge central aperture 207, the sponge 201 can have specific apertures which snugly accommodate the complementary projections, such as 231/232, to secure the scrub button 210 in place within the sponge 201 and prevent further rotation of the scrub button 210. Thus, the sponge central aperture 207 may be multiple smaller apertures specifically shaped to accommodate one or more extending projections from one or both top/bottom surface components, rather than a single round aperture. The central aperture 207 or multiple smaller apertures (not shown) may be disposed at any location on the sponge 201. Further, there are many ways to connect the two (or more) portions of the scrub button 110/210 including, but not limited to, various snap fits, various types of screw motion, threads, various type of turn knobs and locks, various types of clips, etc., all of which are within the scope of the present disclosure, as appreciated by one having ordinary skill in the art.

A third exemplary embodiment of a sponge and sponge assembly is shown in FIGS. 14-20B and FIGS. 23A-24D.

Figure 14:
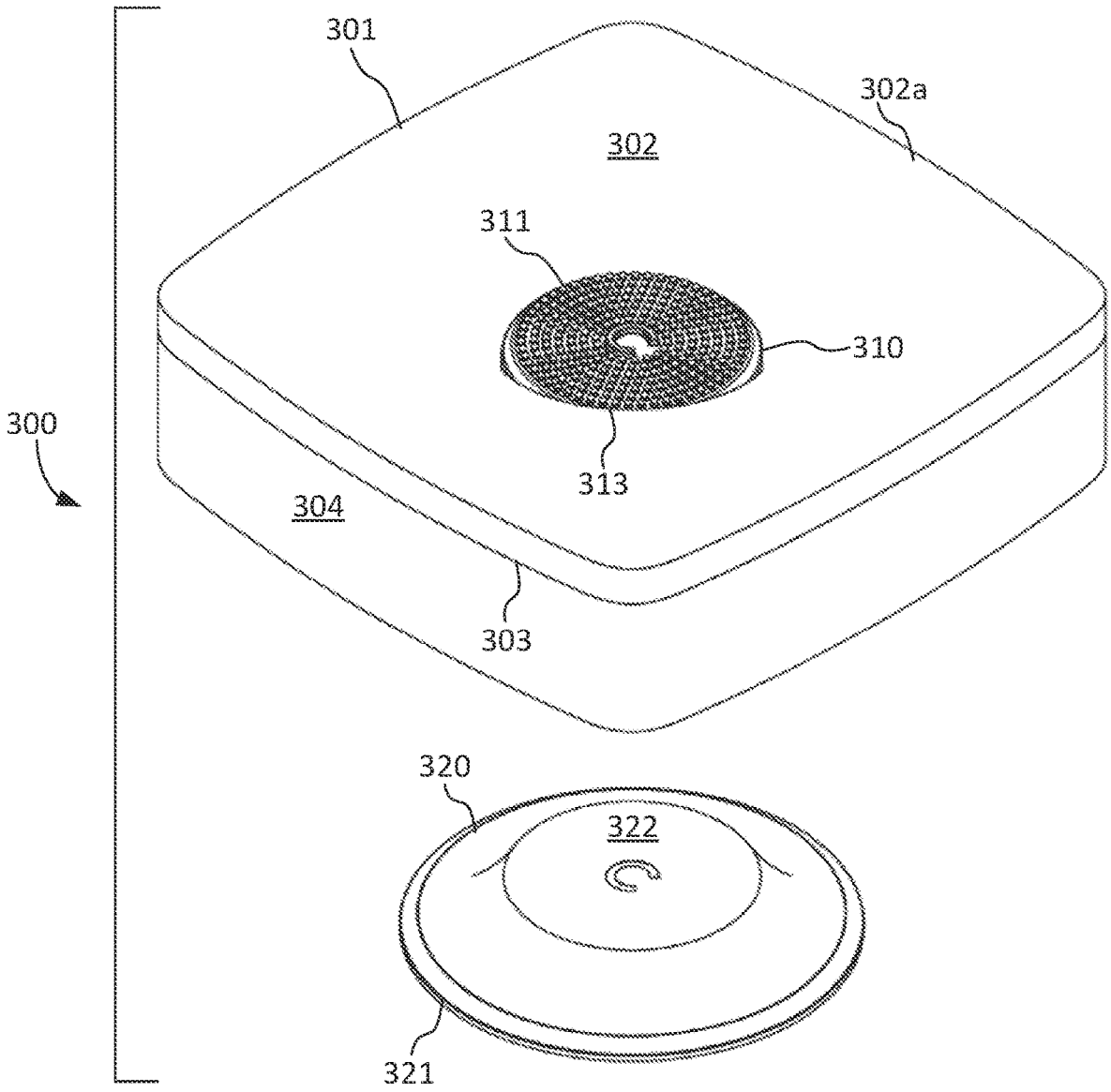
FIG. 14 is a front perspective view of a sponge assembly with a magnetic feature, according to a third exemplary embodiment of the present subject disclosure.
Figure 15:
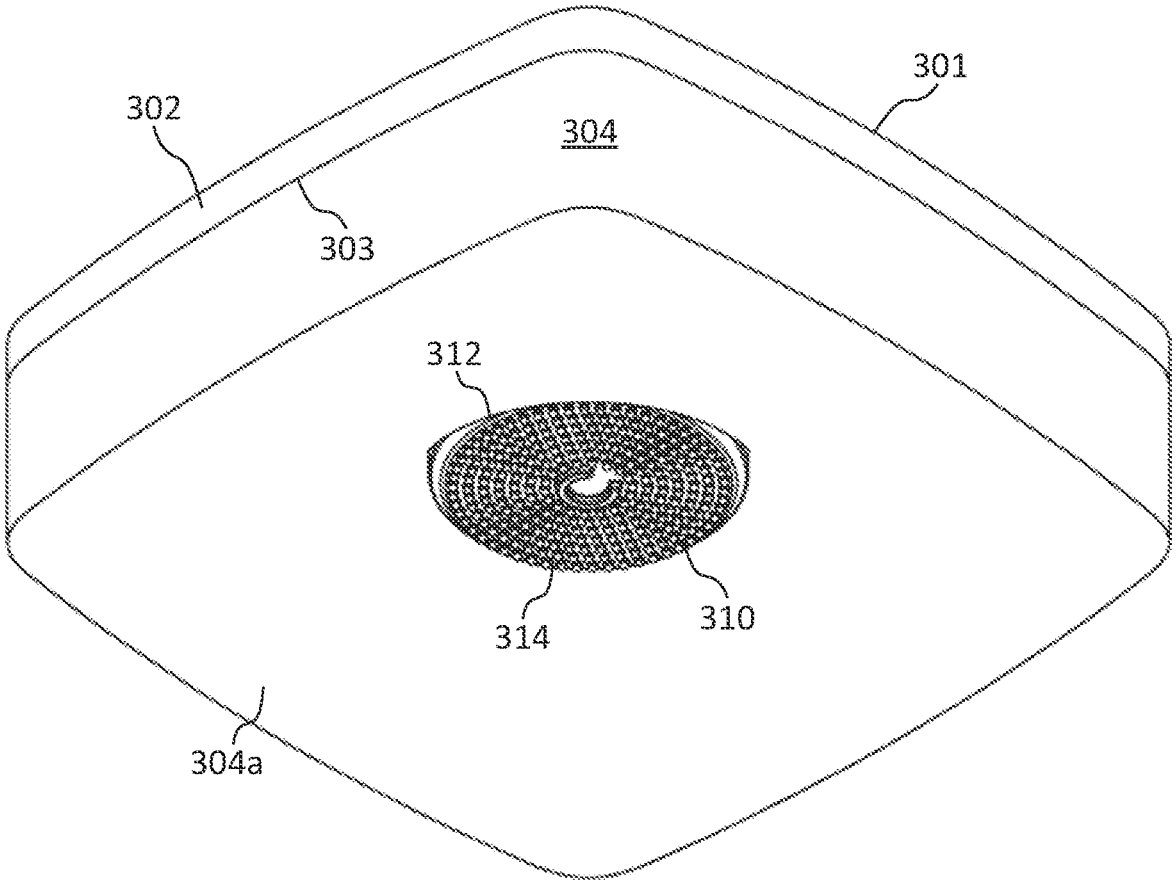
FIG. 15 is a bottom perspective view of a sponge, according to a third exemplary embodiment of the present subject disclosure.
Figure 16:
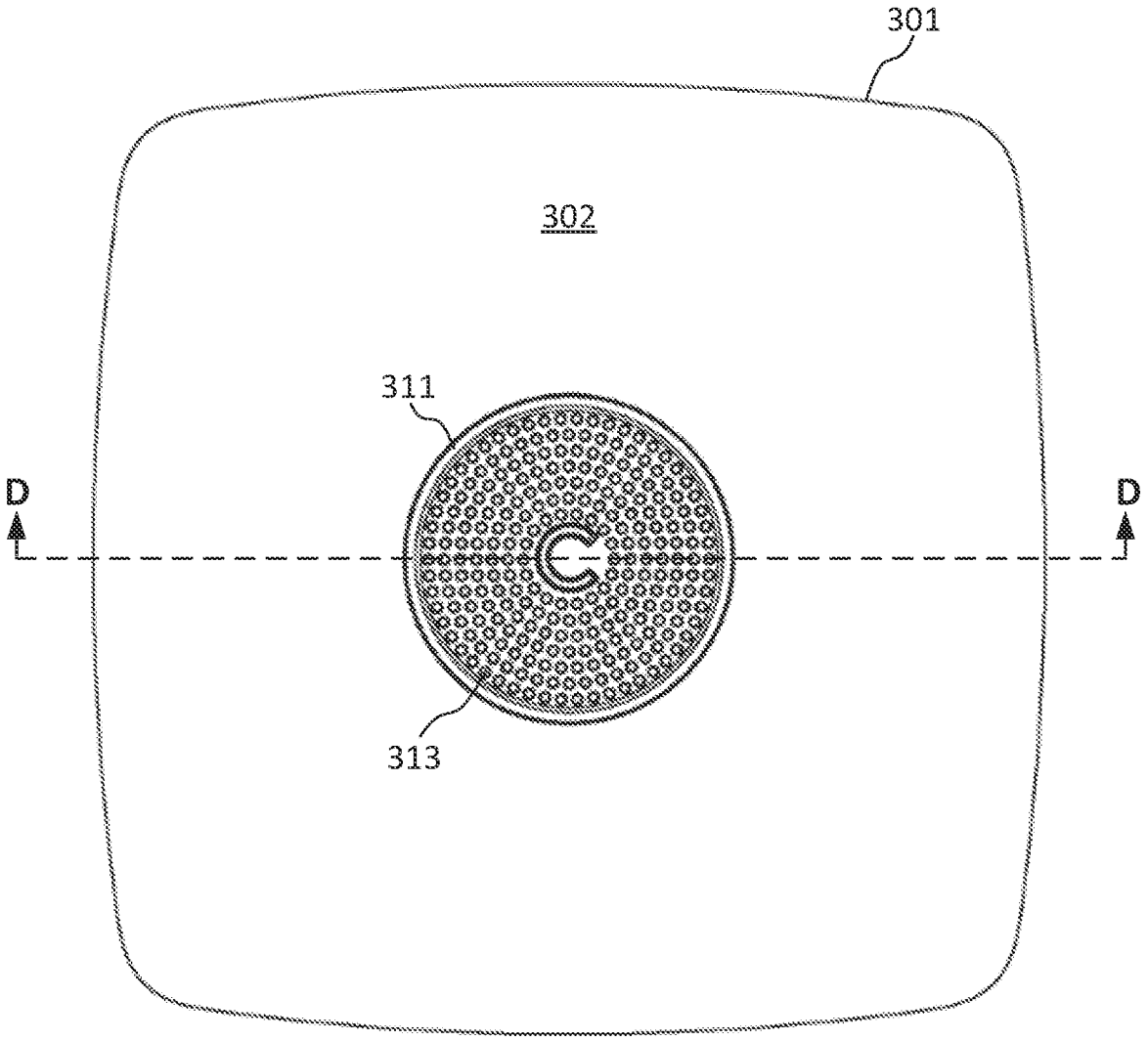
FIG. 16 is a top view of a sponge, according to a third exemplary embodiment of the present subject disclosure.

As shown in FIGS. 14-18C, a sponge assembly 300 includes a sponge 301 and a magnetic element 320. The sponge 301 may be in any shape but is shown as a paver-shaped square, and includes a top portion or top half 302 and a bottom portion or bottom half 304 which are sealed, glued, or affixed together at a junction 303 and do not project outward from the sides of the sponge 301 like the extended seams 103 and 203 of the prior embodiments. The top half 302 has a top sponge surface 302*a* and the bottom half 304 has a bottom sponge surface 304*a*. A scrub button 310 is positioned within the sponge 301 and has a top surface 311 with a plurality of finger-like projections 313, such as bristles, as shown in FIGS. 14 and 16, and a bottom surface 312 with a plurality of finger-like projections 314, such as bristles, as shown in FIG. 15.

Further, the scrub button 310 may have various internal structures between its two outer halves, top surface 311 and bottom surface 312, as described in various embodiments above, and any of such variations may be substituted into any other embodiment shown and described herein.

Bottom half 304 may be constructed of an absorbent material commonly used in sponge fabrication such as, for example, polyester, polyurethane, vegetable cellulose, etc. Sponge top half 302 may also be constructed of the same material used in the construction of bottom half 304. Alternatively, top half 302 may be constructed of material which is coarser, or stiffer, or more abrasive, or have a higher tear strength, or have lower absorbency than that of bottom half 304. Top half 302 may also be constructed of material which is less coarse, less stiff, or less abrasive, or have a lower tear strength, or have lower absorbency than that of bottom half 304. Having two different materials for the top half 302 and bottom half 304 allows the use of different sides of the sponge 301 for different tasks or different objects to be cleaned. Further, having two layers of different abrasiveness allows the softer material (for example, bottom half 304) to be structurally supported by the stiffer material (for example, top half 302), and last longer without wearing out quickly if there was no adjacent stiffer material.

Magnetic element 320 has substantially the same properties as the magnetic element 120 shown in FIGS. 5A-5D and described in detail above.

Figure 18A:
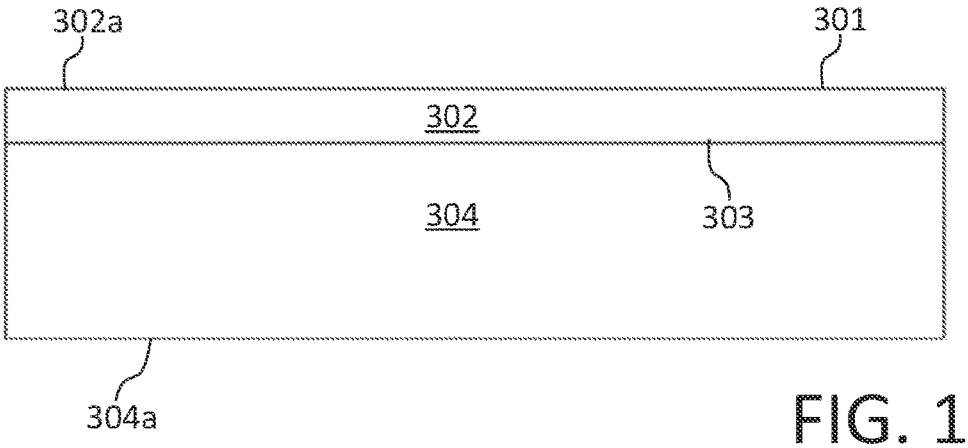
FIG. 18A is a side view of a sponge, according to a third exemplary embodiment of the present subject disclosure.
Figure 18B:
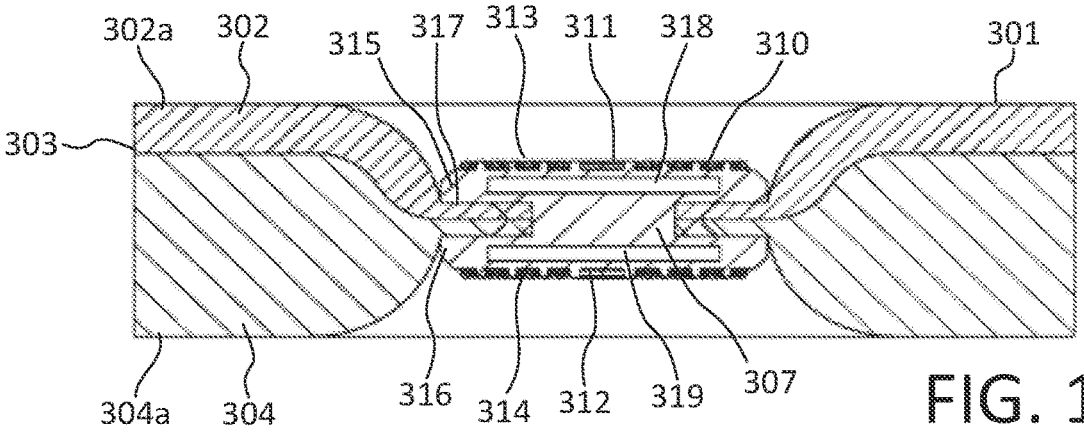
FIG. 18B is a side cross-sectional view of a sponge along plane D-D of FIG. 16 at rest, according to a third exemplary embodiment of the present subject disclosure.
Figure 18C:
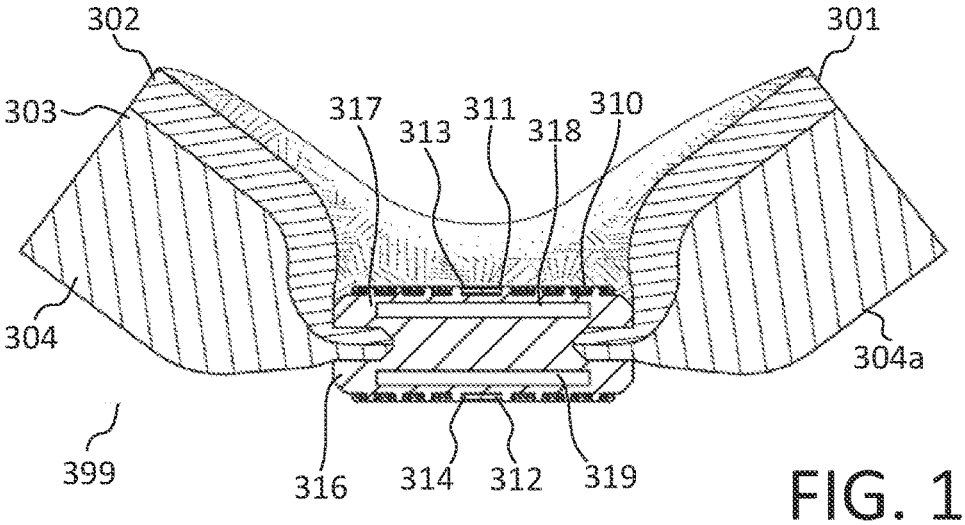
FIG. 18C is a side cross-sectional view of a sponge along plane D-D of FIG. 16 during use such as in FIG. 17A, according to a third exemplary embodiment of the present subject disclosure.

As best shown in FIGS. 18B and 18C, which is the cross-sectional planar cut D-D of FIG. 16, the sponge 301 may be used so that the top sponge surface 302*a* or bottom sponge surface 304*a* makes contact with an object or surface which is to be cleaned or wiped. The top half 302 may have a first abrasive layer, and the bottom half 304 may have a second less abrasive layer. Either the top half 302 or the bottom half 304 may be used as desired, depending on the nature of the object to be cleaned or wiped, and the amount of abrasiveness needed to perform the task.

Figure 17A:
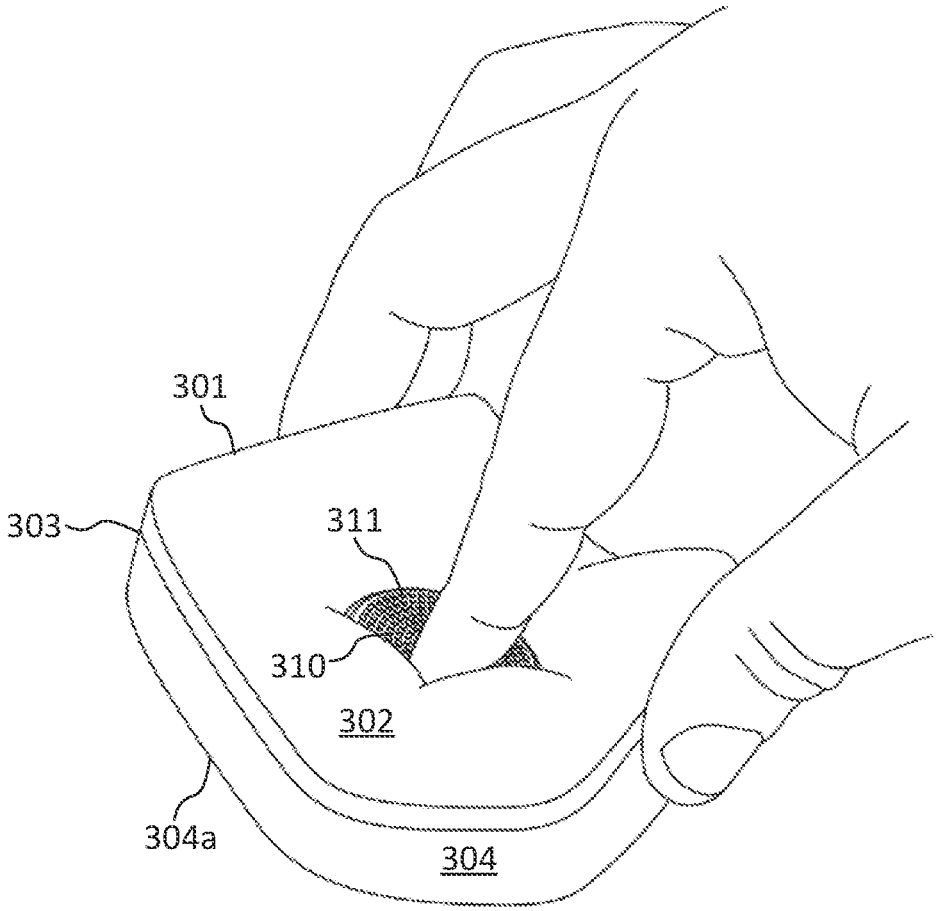
FIG. 17A is an upper perspective view of a sponge in a first use, according to a third exemplary embodiment of the present subject disclosure.

FIG. 17A shows that sponge 301 is flexible as needed to clean a surface with additional bristles. As shown in FIGS. 17A and 18C, given sufficient applied force, for example by exerting a force by a finger on the top surface 311 of the scrub button 310, the sponge 301 may bend enough so that the bottom surface 312 of the scrub button 310 is extended below the bottom planar surface of the bottom sponge surface 304*a*. In such a configuration, or in the opposite configuration pushing on the bottom surface 312 to extend the top surface 311 of the scrub button 310, the projections 313, 314 on the top surface 311 or bottom surface 312 of the scrub button 310 can make contact with a surface 399 of an object to be cleaned. The higher stiffness of the projections 313, 314 with respect to the top half or bottom half 302, 304 provides additional cleaning/wiping force, as needed.

Figure 17B:
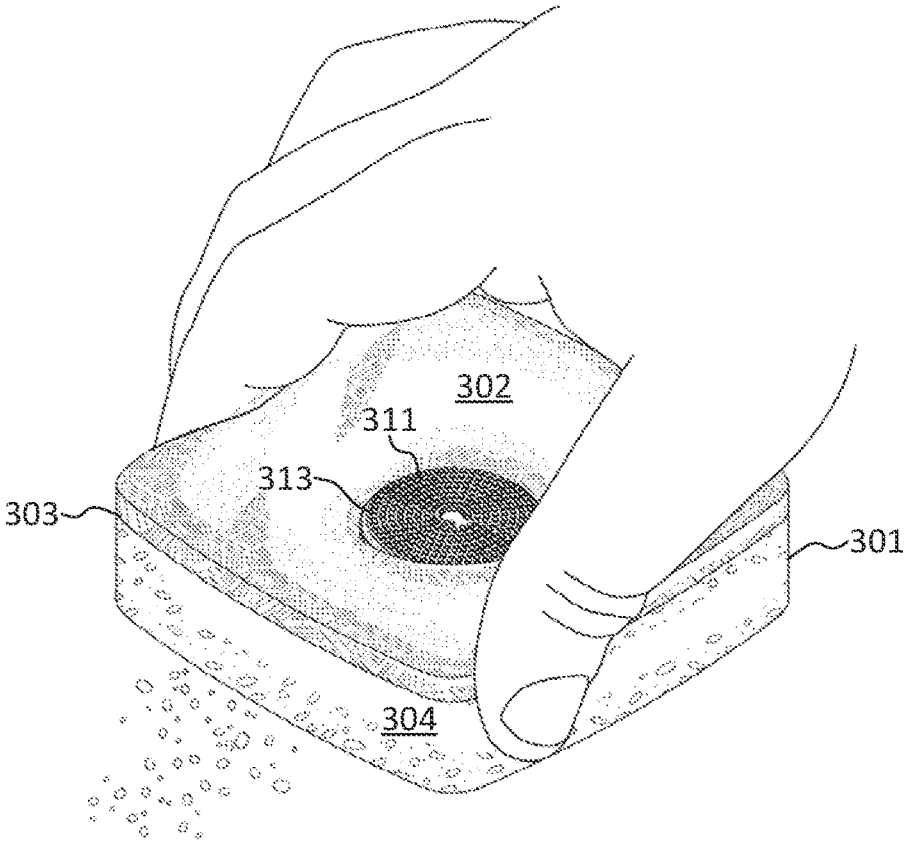
FIG. 17B is an upper perspective view of a sponge in a second use, according to a third exemplary embodiment of the present subject disclosure.
Figure 17C:
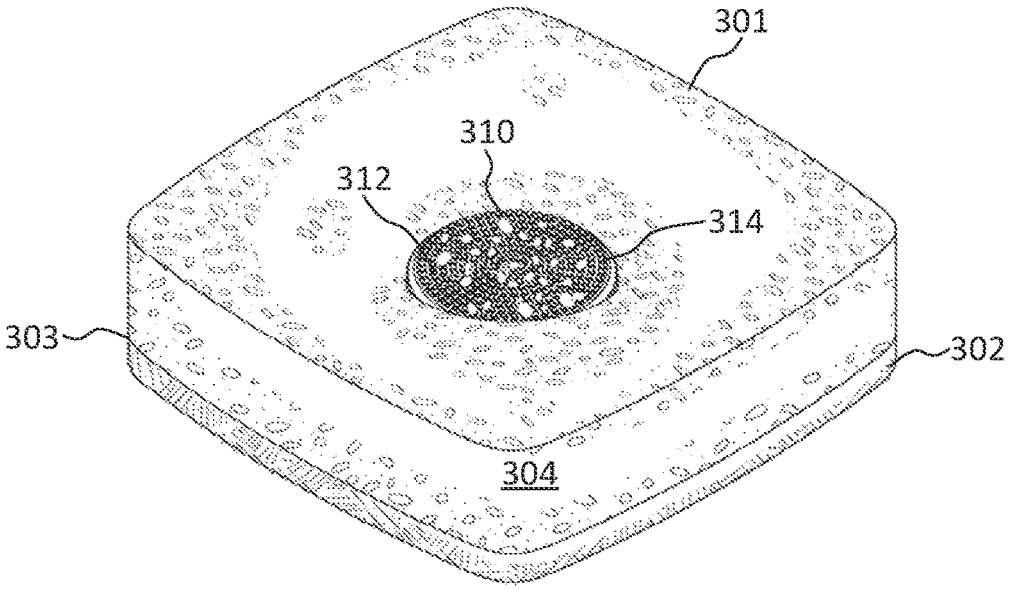
FIG. 17C is a bottom perspective view of a sponge in the second use, according to a third exemplary embodiment of the present subject disclosure.

FIGS. 17B-17C show that the projections 313, 314 may act as a crumb catcher that captures small particles and debris when wiping the sponge 301 over a surface. The crumb catching feature of the scrub button 310 further helps cleaning surfaces with a plurality of crumbs. After wiping a surface, the user may flip over the sponge 301 and quickly brush off or rinse out the crumbs or debris caught in the projections 313, 314 of the scrub button 310. The recessed location of the scrub button 310 further enhances the ability to trap small particles in the recessed space and projections 313, 314 and prevent unnecessary contamination of the sponge 301.

FIGS. 18B-18C show an exemplary embodiment of the sponge 301 and the scrub button 310. The scrub button 310 and its position, configuration, features, and replaceability are substantially the same as that described in detail in FIGS. 1-7C and, thus, will not be repeated here.

A structural difference in the embodiments shown in FIGS. 14-18C and those shown in FIGS. 1-7C, and in FIGS. 8-13B, is the number and position of layers of material which comprise the sponge body. In the first embodiment, shown in FIGS. 1-7C, the top half 102 was substantially equal in size to the bottom half 104 and they were sealed together with seam 103. Similarly, in the second embodiment, shown in FIGS. 8-13B, the top half 202 was substantially equal in size to the bottom half 204 and they were sealed together with seam 203.

However, in the third embodiment shown in FIGS. 14-18C, the number and size of material used in the sponge 301 is different. FIGS. 14-18C show an embodiment having two layers of material, including a thinner top half 302 and a thicker bottom half 304, affixed together at junction 303.

Figure 19A:
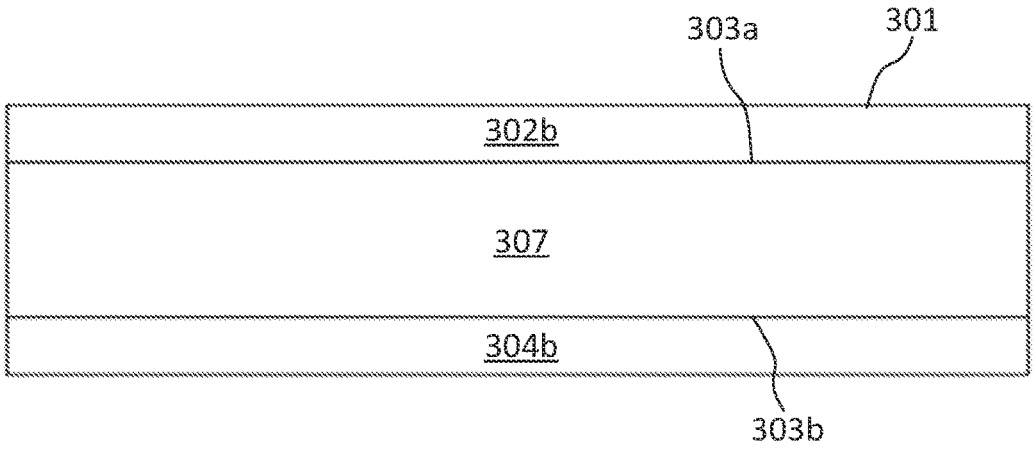
FIG. 19A is a side view of a sponge, according to an alternative third exemplary embodiment of the present subject disclosure.
Figure 19B:
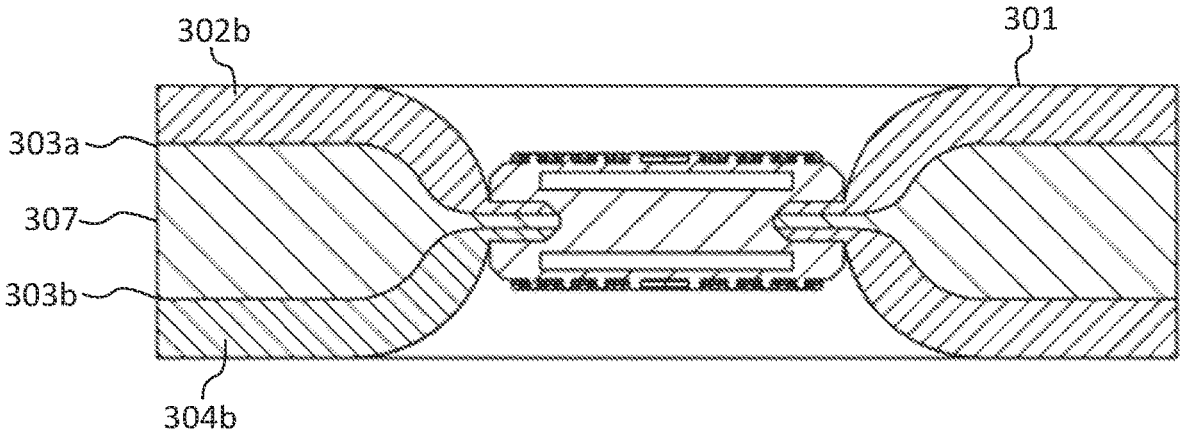
FIG. 19B is a side cross-sectional view of a sponge along plane D-D of FIG. 16 at rest, according to an alternative third exemplary embodiment of the present subject disclosure.

FIGS. 19A-19B show another exemplary embodiment which includes two layers of thinner materials, a top layer 302*b* and a bottom layer 304*b*, and a central layer 307 that is sandwiched between the two thinner outer layers 302*b* and 304*b*. The central layer 307 may be thicker or thinner depending on the dimensions of the top or bottom layers 302*b*,304*b*. The central layer 307 may have different material properties from that of the top and/or bottom layers 302*b*, 304*b*. Each layer is affixed to an adjacent layer through a separate junction. A junction 303*a* connects the top layer 302*b* with the central layer 307, and a junction 303*b* connects bottom layer 304*b* with central layer 307. The three layer configuration is maintained throughout the sponge 301, as shown in the cross section of FIG. 19B.

Figure 20A:
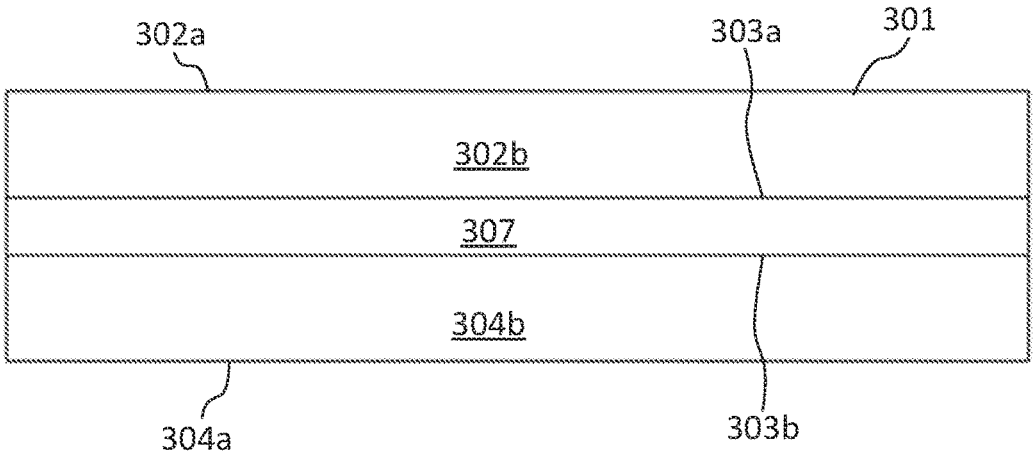
FIG. 20A is a side view of a sponge, according to an alternative third exemplary embodiment of the present subject disclosure.
Figure 20B:
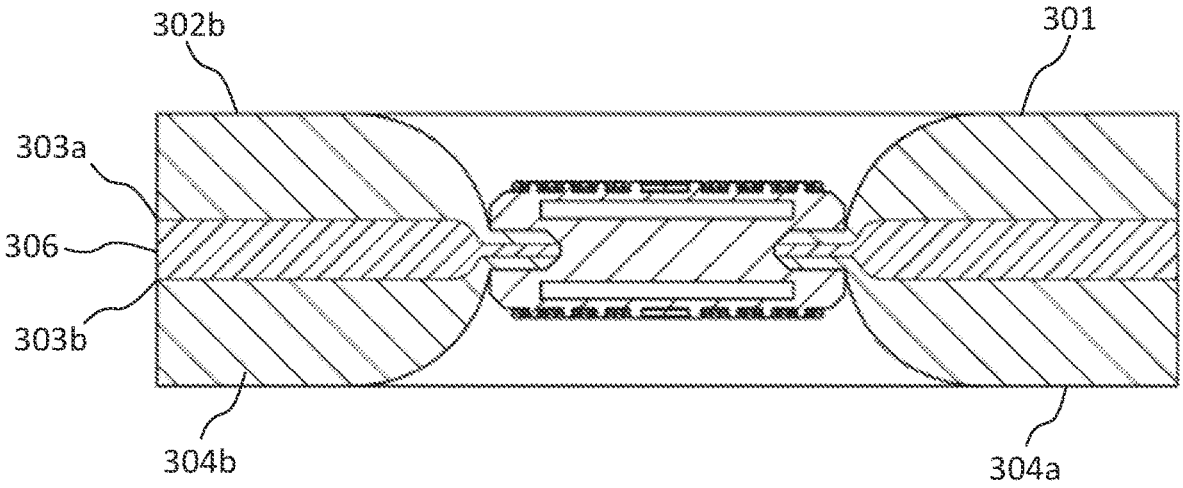
FIG. 20B is a side cross-sectional view of a sponge along plane D-D of FIG. 16 at rest, according to an alternative third exemplary embodiment of the present subject disclosure.
Figure 21A:
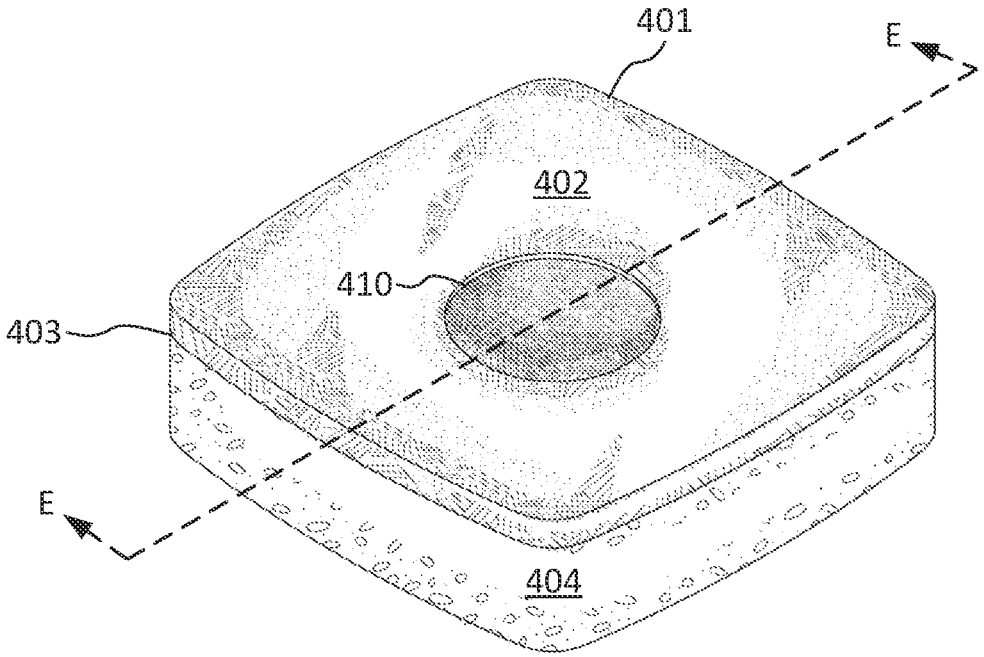
FIG. 21A is a top perspective view of a sponge, according to a fourth exemplary embodiment of the present subject disclosure.
Figure 21B:
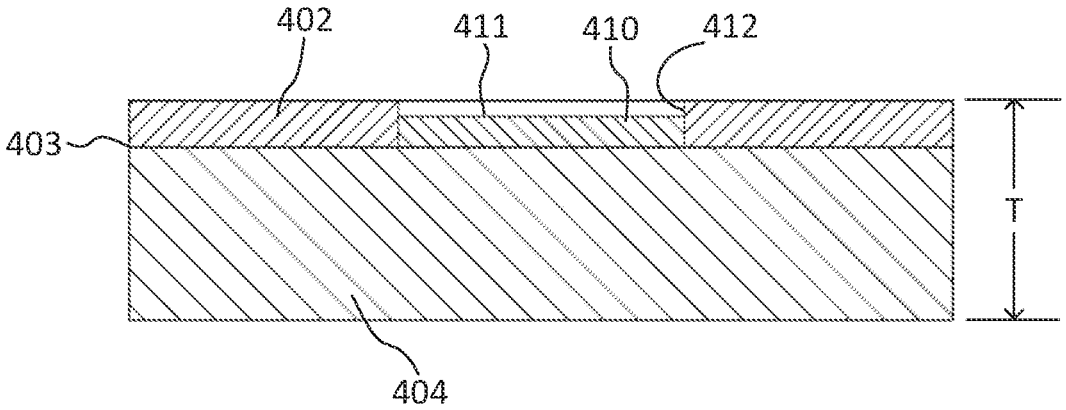
FIG. 21B is a side cross-sectional view of a sponge along plane E-E of FIG. 21A, according to a fourth exemplary embodiment of the present subject disclosure.

FIG. 20A shows another exemplary embodiment in which the top layer 302*b* and the bottom layer 304*b* possesses a thickness greater than that of central layer 307. As shown in FIG. 20A, the top layer 302*b* and bottom layer 304*b* are roughly of equal thickness. However, the top layer 302*b*, the central layer 307 and the bottom layer 304*b* may all possess the same or different thicknesses relative to one another. Central layer 307 is sandwiched between the two thicker outer layers 302*b* and 304*b*. The central layer 307 may have different material properties from that of the top and/or bottom layers 302*b*, 304*b*. Each layer is affixed to an adjacent layer through a separate junction. Junction 303*a* connects the top layer 302*b* with the thinner central layer 307, and junction 303*b* connects the central layer 307 with the bottom layer 304*b*. The three layer configuration is maintained throughout the sponge 301, as shown in the cross section of FIG. 20B.

The use of multiple layers of material, as shown in FIGS. 14-20B provides advantages such as creating a sponge specific for certain uses. For example, a larger sponge for use in washing cars may need a configuration shown in FIG. 20A with a stiffer internal layer surrounded by two thicker, softer and more absorbent material layers. In contrast, a smaller sponge for washing dishes may have an equal amount of soft and hard material. One having ordinary skill in the art would appreciate that different layering techniques may be used to create an ideal sponge for a given task. Such variations not shown and described within the present disclosure are within the scope of the subject disclosure, as would be appreciated by one having ordinary skill in the art.

A fourth exemplary embodiment of a sponge 401 is shown in FIG. 21A-22B. The sponge 401 may be in any shape but is shown as a paver-shaped square, and includes a top portion or top half 402 and a bottom portion or bottom half 404 which are sealed, glued, or affixed together at a junction 403 and do not project outward from the sides of the sponge 401 like the extended seams 103 and 203 of the prior embodiments.

Another configuration for a scrub button 410 is positioned within the sponge 401, however, unlike the scrub buttons 110, 210, 310 of the previous embodiments, scrub button 410 may not extend completed through the combined thickness (T) of sponge 401. Scrub button 410 may be inset in a recessed portion 412 of the top half 402 of the sponge 401. Recessed portion 412 may be disposed at any location on the sponge 410, such as, but not limited to, top half 402, bottom half 404 or side of sponge 401. This inset positioning is an advantage when using the sponge 401 as a crumb catcher as described in more detail previously in FIGS. 17A-17B. Scrub button 410 may have a more abrasive surface 411 than previously discussed embodiments. The surface 411 may be similar to a fabric scouring pad or the like.

A magnet or a metallic material may be integrated into scrub button 410. The surface 411 may itself be composed of a ferromagnetic and adapted to mate with a complementary magnetic element (120, 220, 320). The perimeter of the scrub button 410 may be a magnetic ring, or veins of magnetic material may run through the surface 411 of the scrub button 410.

Figure 22A:
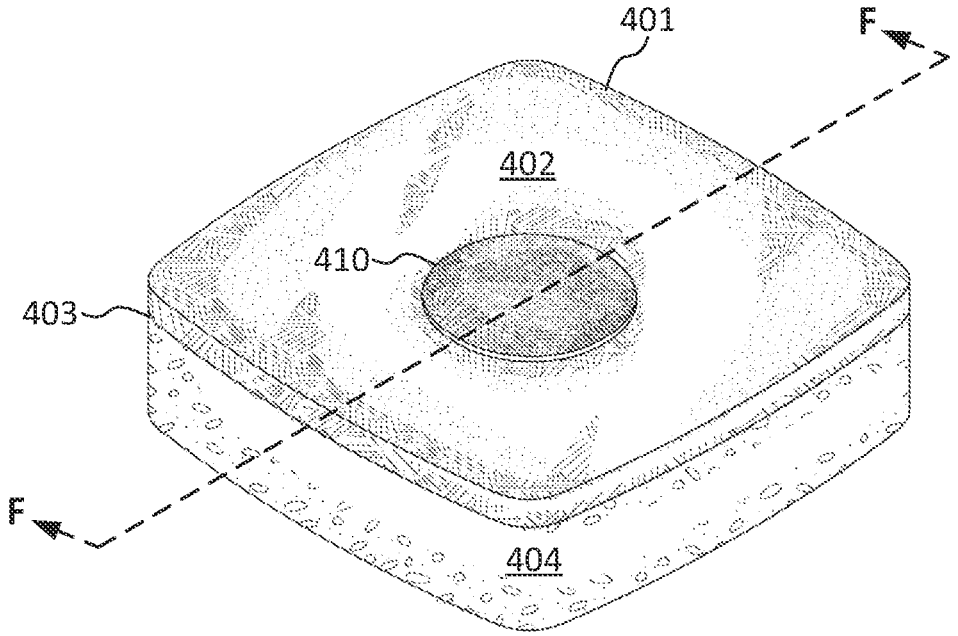
FIG. 22A is a top perspective view of a sponge, according to an alternate fourth exemplary embodiment of the present subject disclosure.
Figure 22B:
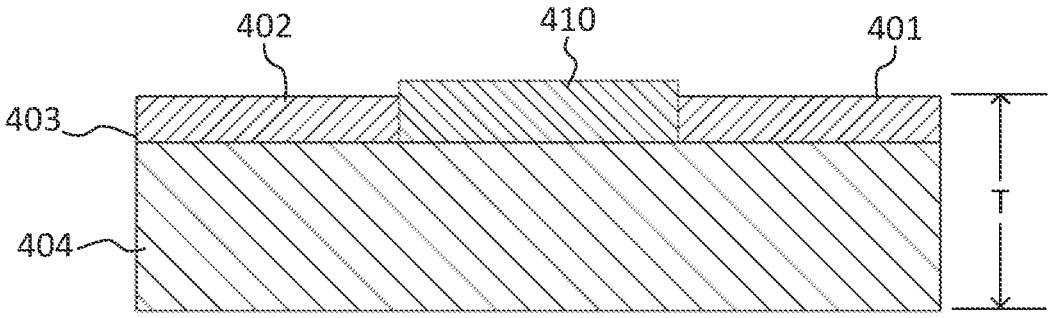
FIG. 22B is a side cross-sectional view of a sponge along plane F-F of FIG. 22A, according to a fourth exemplary embodiment of the present subject disclosure.
Figure 23A:
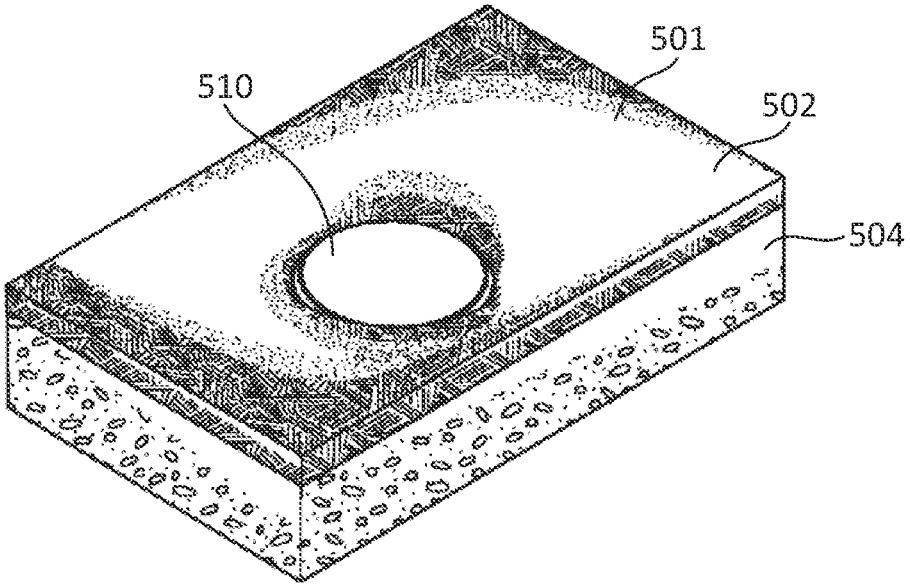
FIG. 23A is a top perspective view of a sponge, according to an alternate third exemplary embodiment of the present subject disclosure.
Figure 23B:
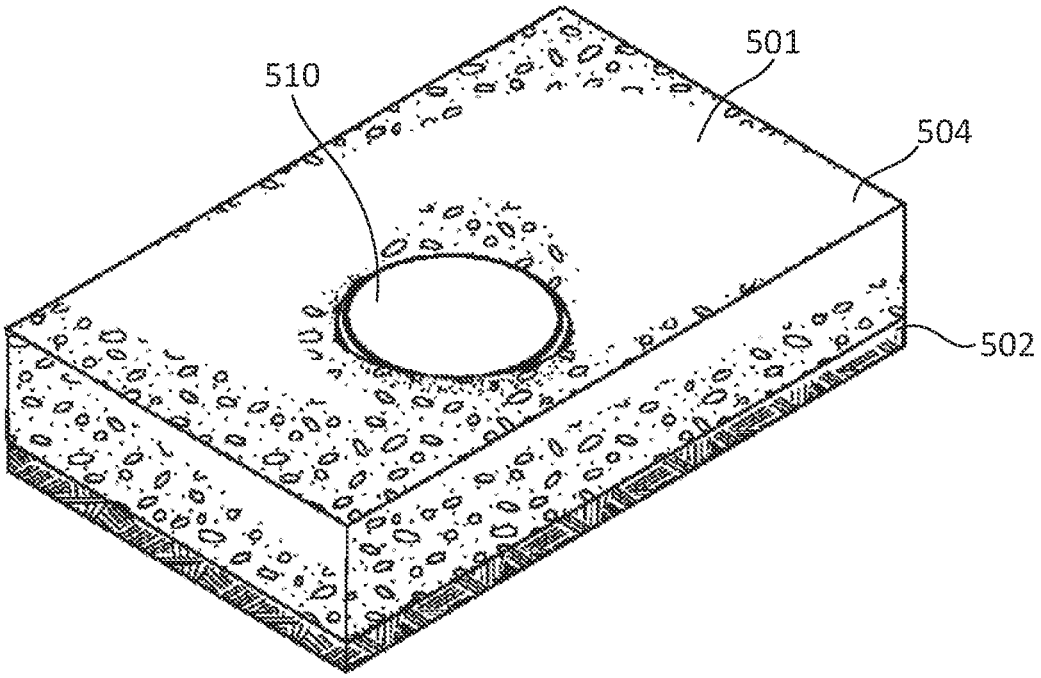
FIG. 23B is a bottom perspective view of a sponge, according to an alternate third exemplary embodiment of the present subject disclosure.
Figure 23C:
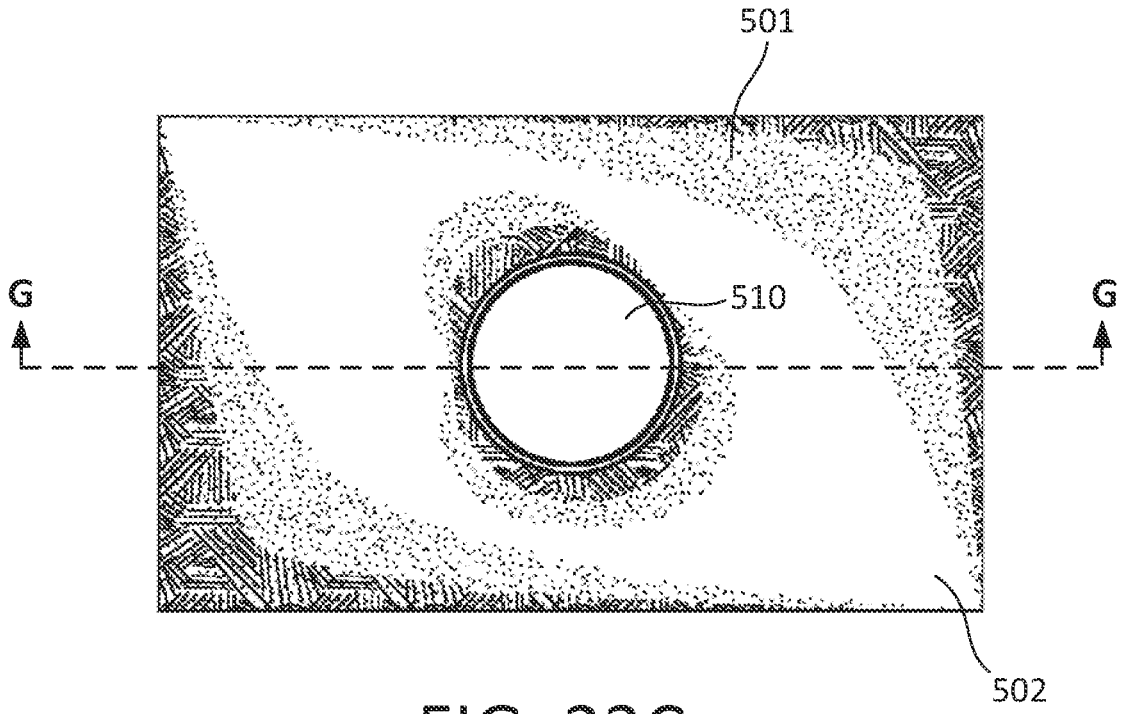
FIG. 23C is a top view of a sponge, according to an alternate third exemplary embodiment of the present subject disclosure.
Figure 23D:
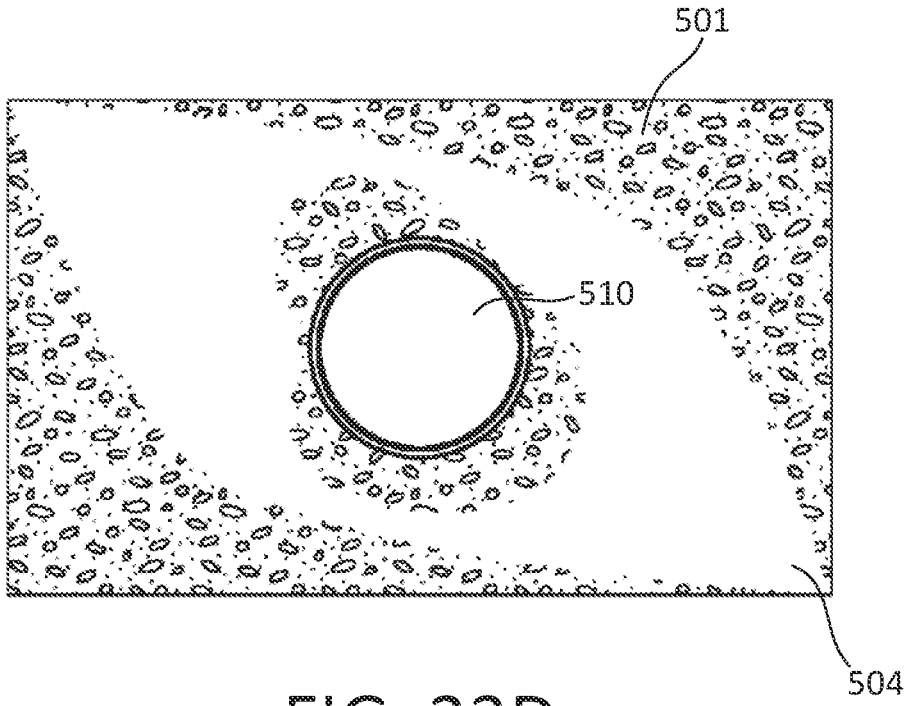
FIG. 23D is a bottom view of a sponge, according to an alternate third exemplary embodiment of the present subject disclosure.
Figure 23E:
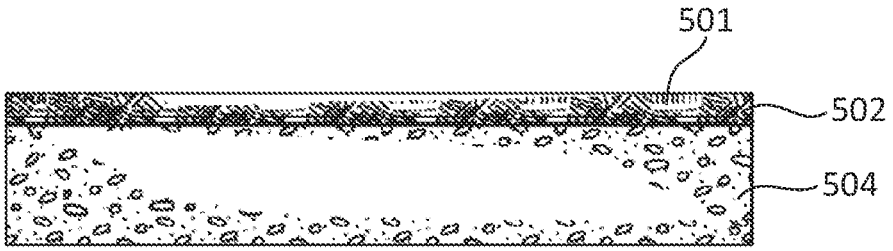
FIG. 23E is a side view of a sponge, according to an alternate third exemplary embodiment of the present subject disclosure.
Figure 23F:
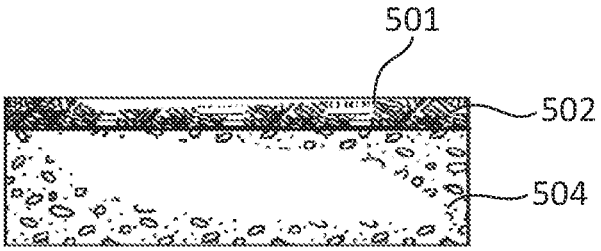
FIG. 23F is a front view of a sponge, according to an alternate third exemplary embodiment of the present subject disclosure.
Figure 23G:
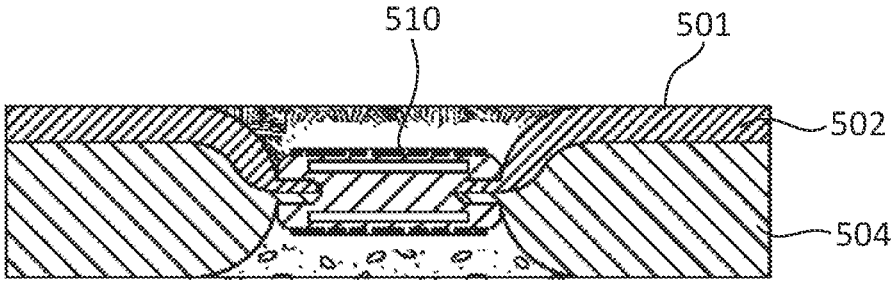
FIG. 23G is a side cross-sectional view of a sponge along plane G-G of FIG. 23C, according to an alternate third exemplary embodiment of the present subject disclosure.
Figure 24A:
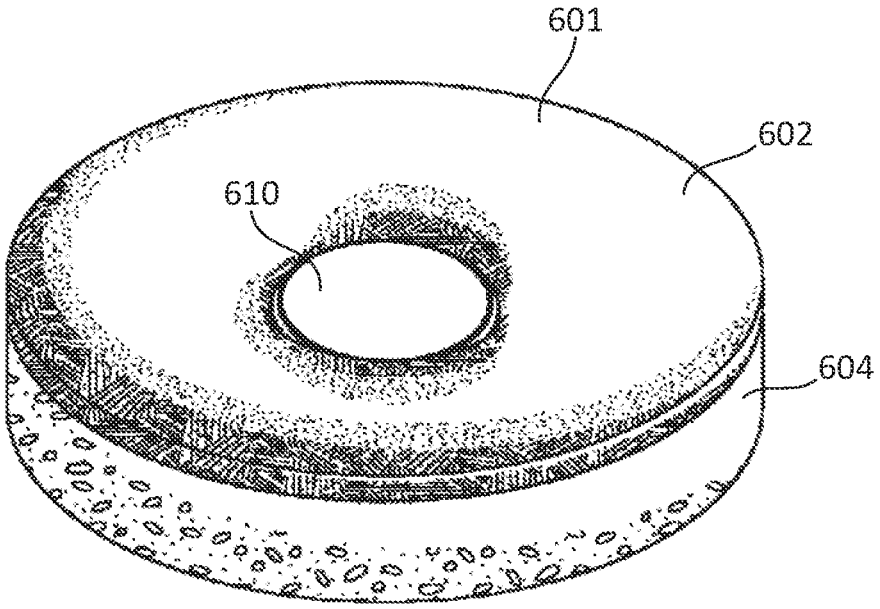
FIG. 24A is a top perspective view of a sponge, according to an alternate third exemplary embodiment of the present subject disclosure.
Figure 24B:
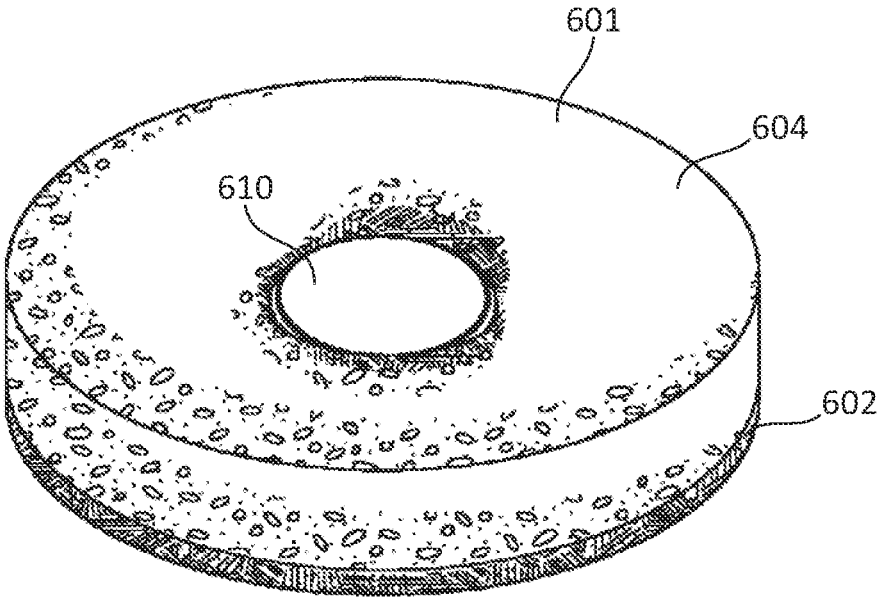
FIG. 24B is a bottom perspective view of a sponge, according to an alternate third exemplary embodiment of the present subject disclosure.
Figure 24C:
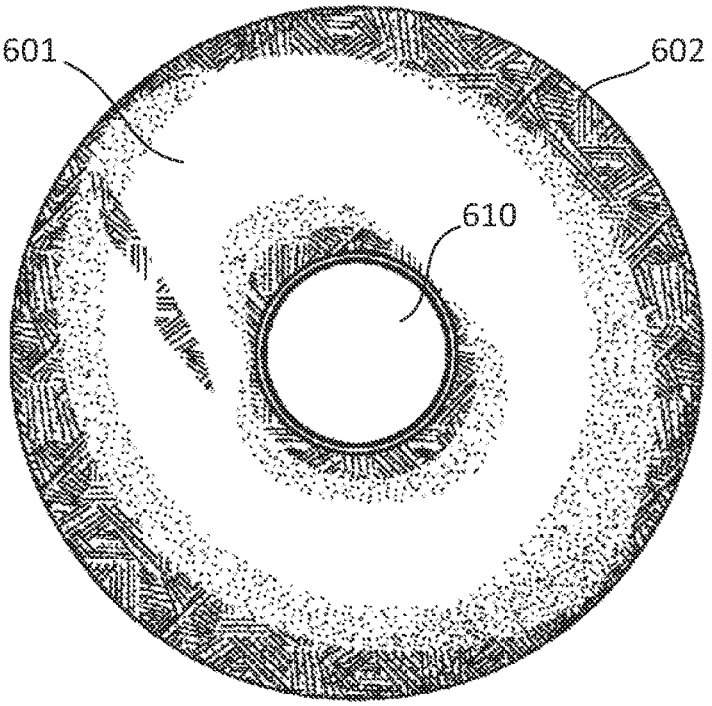
FIG. 24C is a top view of a sponge, according to an alternate third exemplary embodiment of the present subject disclosure.
Figure 24D:
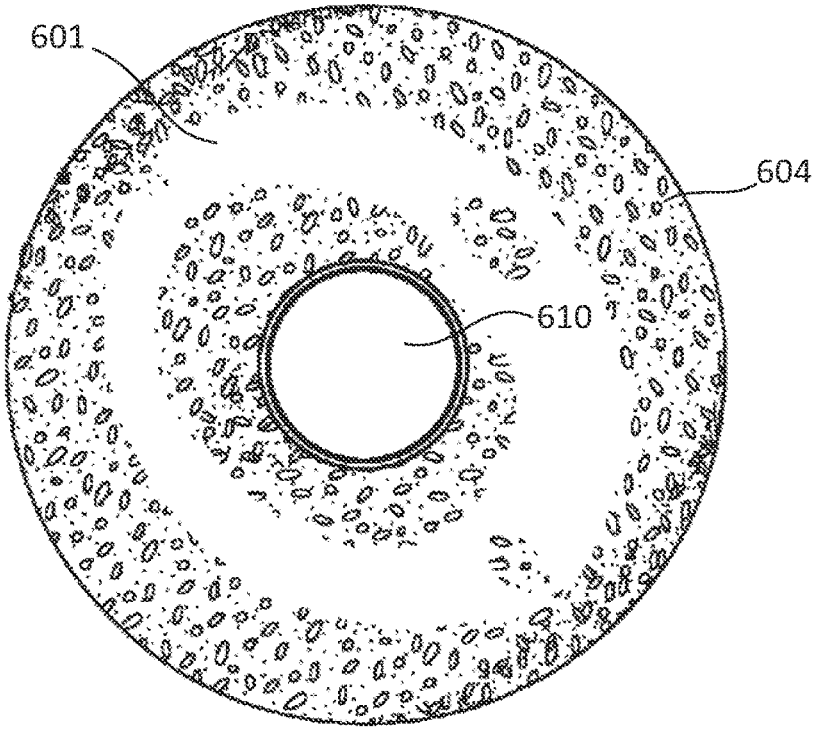
FIG. 24D is a bottom view of a sponge, according to an alternate third exemplary embodiment of the present subject disclosure.

Alternatively, as shown in FIGS. 22A-B, the scrub button 410 may be constructed to extend past the top surface 402*a* of the top half 402 of the sponge 401.

FIGS. 23A-G and FIGS. 24A-D show various other shapes and sizes the sponge 301 may take. The sponges 501, 601 composed of rectangular and circular shapes shown, include the features and functionalities of those shown and described above in the previous sponge assembly embodiments 100, 200, 300. The description provided above with respect to the various embodiments apply to these alternate embodiments and will not be repeated for sake of brevity.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A sponge, comprising:
a first material having a first material property;
a second material having a second material property; and
a magnetic button connecting to the first material and to the second material,
wherein the magnetic button contains two components which are connected together through snap fit.

2. The sponge of claim 1, further comprising a magnetic element that magnetically attaches to the magnetic button.

3. The sponge of claim 1, wherein the magnetic button is removably connected to the first and second materials.

4. The sponge of claim 2, wherein the magnetic button contains a ferromagnetic metal, and the magnetic element contains a magnet.

5. The sponge of claim 2, wherein the magnetic button contains a magnet, and the magnetic element contains a ferromagnetic metal.

6. The sponge of claim 2, wherein the magnetic element is encased in a silicone material.

7. The sponge of claim 6, wherein a bottom face of the magnetic element is planar and attaches to a surface via friction.

8. The sponge of claim 6, wherein the magnetic element attaches to a surface via a magnetic attraction.

9. The sponge of claim 1, wherein the first material and the second material are layered upon each other and share a complete external peripheral edge.

10. The sponge of claim 9, wherein the external peripheral edge of the first material and the second material is sealed with a seam.

11. The sponge of claim 1, wherein the magnetic button is positioned centrally within the first material and the second material such that a top portion of the button is adjacent to an exterior surface of the first material and a bottom portion of the button is adjacent to an exterior surface of the second material.

12. The sponge of claim 11, wherein at least the top portion or the bottom portion of the magnetic button has ridged projections.

13. A sponge, comprising:
a first material having a first material property;
a second material having a second material property; and
a magnetic button connecting to the first material and to the second material,
wherein the magnetic button contains two components which are connected together.

14. The sponge of claim 13, further comprising a magnetic element that magnetically attaches to the magnetic button.

15. The sponge of claim 13, wherein the magnet button is removably-connected to the first and second materials.

16. The sponge of claim 13, wherein the magnetic button fixedly connects the two components.

17. The sponge of claim 13, wherein the magnetic button contains two components which are connected together by a threaded mechanism.

18. The sponge of claim 14, wherein the magnetic element is encased in a silicone material.

19. A sponge assembly, comprising:

a sponge comprising:

a top portion;

a bottom portion; and a magnetic button connecting to the top portion and the bottom portion, the magnetic button having a spool-shaped configuration with an upper section, a lower section, and a middle section; and a magnetic element that magnetically attaches to the magnetic button.

20. The sponge of claim 19, wherein the magnetic element is encased in a silicone material.

* * * * *